US012521641B2

(12) United States Patent
Rusch et al.

(10) Patent No.: US 12,521,641 B2
(45) Date of Patent: Jan. 13, 2026

(54) INTERACTIVE TOY

(71) Applicant: MOOSE CREATIVE MANAGEMENT PTY LIMITED, Cheltenham (AU)

(72) Inventors: Miguel Rusch, Kilsyth (AU); Wesley Thomas, Cheltenham (AU); Dean Del Guidice, Melbourne (AU); Nicholas St Clair Max Heine, St Kilda West (AU); Craig Stevenson, Cheltenham (AU)

(73) Assignee: MOOSE CREATIVE MANAGEMENT PTY LIMITED, Cheltenham (AU)

( * ) Notice: Subject to any disclaimer, the term of this patent is extended or adjusted under 35 U.S.C. 154(b) by 0 days.

(21) Appl. No.: 18/799,533

(22) Filed: Aug. 9, 2024

(65) Prior Publication Data

US 2025/0050232 A1 Feb. 13, 2025

Related U.S. Application Data

(60) Provisional application No. 63/518,985, filed on Aug. 11, 2023.

(51) Int. Cl.
*A63H 3/40* (2006.01)
*A63H 3/02* (2006.01)

(52) U.S. Cl.
CPC ..... *A63H 3/40* (2013.01); *A63H 3/02* (2013.01); *A63H 2200/00* (2013.01)

(58) Field of Classification Search
CPC ..... A63H 3/40; A63H 2/365; A63H 2200/00; A63H 13/005
See application file for complete search history.

(56) References Cited

U.S. PATENT DOCUMENTS

| | | | | |
|---|---|---|---|---|
| 2,045,962 | A | 6/1936 | Rastetter | |
| 3,053,009 | A | 9/1962 | Ostrander | |
| 5,376,040 | A | 12/1994 | Hickman et al. | |
| 6,149,490 | A * | 11/2000 | Hampton | A63H 3/48 446/298 |
| 9,474,981 | B1 | 10/2016 | Forti | |
| 10,449,463 | B2 | 10/2019 | Sufer et al. | |
| 2005/0287913 | A1 * | 12/2005 | Ellman | A63H 3/365 446/384 |
| 2007/0128979 | A1 | 6/2007 | Shackelford et al. | |
| 2008/0050999 | A1 | 2/2008 | Jang et al. | |
| 2016/0077788 | A1 * | 3/2016 | Wong | A63H 3/28 704/275 |
| 2017/0319974 | A1 | 11/2017 | Karsten | |
| 2022/0054941 | A1 | 2/2022 | Ciganko et al. | |

FOREIGN PATENT DOCUMENTS

DE 29511192 U1 10/1995

OTHER PUBLICATIONS

Search Report and Written Opinion in PCT Application No. PCT/US2024/041700, mailed on Nov. 14, 2024, in 20 pages.

* cited by examiner

*Primary Examiner* — Kevin Y Kim
(74) *Attorney, Agent, or Firm* — KNOBBE, MARTENS, OLSON & BEAR, LLP

(57) ABSTRACT

The present disclosure generally relates to an interactive toy that includes an eye, a sensor and a controller. In some implementation examples, the sensor generates an electrical signal in response to a contact applied on the sensor by a user. In response to receiving the electrical signal generated by the sensor, the controller causes the eye open to a certain degree.

19 Claims, 37 Drawing Sheets

INTERACTIVE TOY

CROSS-REFERENCE TO RELATED APPLICATION

This application claims benefit under 35 U.S.C. 119(e) to U.S. Provisional Patent Application No. 63/518,985, filed Aug. 11, 2023, the entire disclosure of which is hereby incorporated by reference herein in its entirety. Any and all priority claims identified in the Application Data Sheet, or any corrections thereto, are hereby incorporated by reference under 37 CFR 1.57.

TECHNICAL FIELD

The present disclosure generally relates to a toy. More specifically, the present disclosure relates to an interactive toy that provides various facial expressions for an interactive user experience.

BACKGROUND

Dolls or plush toys have proven to be popular and long-lasting toy products. Nevertheless, there remains a continuing need for providing more interactive and amusing toys to enhance a user's experience.

SUMMARY

The present disclosure is directed to a toy resembling a miniature bear. Of course, it should be noted that the toy is not limited to the illustrated shape or size and can have any other shapes or sizes and still fall within the scope of this disclosure. An aspect of the disclosure is a toy showing different facial expressions. In certain embodiments, the different facial expressions are made in response to different inputs from a user. For example, the toy can include a pair of eyes, some body parts, one or more sensors and/or one or more controllers. When a sensor senses a contact applied by the user, the sensor may generate an electrical signal. In response to receiving the electrical signal, the controller may cause movements of one or more of the eyes and/or the body part of the toy.

In some aspects, the techniques described herein relate an interactive toy including an eye, a first sensor configured to generate a first electrical signal in response to a first contact applied on the first sensor by a user, and a controller. In response to receiving the first electrical signal, the controller causes the eye to open to a first degree.

In some aspects, the techniques described herein relate to an interactive toy, wherein the first sensor is a capacitive sensor.

In some aspects, the techniques described herein relate to an interactive toy, further comprising a second sensor configured to generate a second electrical signal in response to a second contact applied on the second sensor by the user, wherein in response to receiving the second electrical signal, the controller causes the eye to open to a second degree, the second degree being different than the first degree.

In some aspects, the techniques described herein relate to an interactive toy, further comprising a motor, wherein in response to receiving the first electrical signal, the controller triggers the motor to rotate a first number of turns to cause the eye to open to the first degree, and wherein in response to receiving the second electrical signal, the controller triggers the motor to rotate a second number of turns to cause the eye to open to the second degree.

In some aspects, the techniques described herein relate to an interactive toy further comprising a body part, wherein the body part is a head or an ear of the interactive toy, and wherein in response to receiving the first electrical signal, the controller further causes the body part to move in a first direction.

In some aspects, the techniques described herein relate an interactive toy including a facial feature configured to change from a first shape to a second shape, a sensor configured to generate an electrical signal in response to a user interaction, one or more rotating discs, and a controller. In response to receiving the electrical signal, the controller causes the one or more rotating discs to change a shape of the facial feature from the first shape to the second shape.

In some aspects, the techniques described herein relate to an interactive toy, wherein the facial feature is an eye.

In some aspects, the techniques described herein relate to an interactive toy, wherein one of the first shape or the second shape is OPEN.

In some aspects, the techniques described herein relate to an interactive toy, wherein one of the first shape or the second shape is HAPPY.

In some aspects, the techniques described herein relate to an interactive toy, wherein one of the first shape or the second shape is WINK.

In some aspects, the techniques described herein relate to an interactive toy, wherein one of the first shape or the second shape is ANGRY.

In some aspects, the techniques described herein relate to an interactive toy, wherein one of the first shape or the second shape is SAD.

In some aspects, the techniques described herein relate to an interactive toy, wherein one of the first shape or the second shape is BLINK.

In some aspects, the techniques described herein relate to an interactive toy, further comprising a body part, wherein the controller is further configured to cause the body part to move in a first direction.

In some aspects, the techniques described herein relate to an interactive toy, wherein the body part is a head.

In some aspects, the techniques described herein relate to an interactive toy including an eye configured to change from a first shape to a second shape, a sensor configured to generate an electrical signal in response to a user interaction, a plurality of movement arms, and a controller. In response to receiving the electrical signal, the controller causes the plurality of movement arms to change a shape of the eye from the first shape to the second shape.

In some aspects, the techniques described herein relate to an interactive toy, wherein the plurality of movement arms comprises at least three movement arms, and wherein each of the at least three movement arms couples to the eye at a different connection point.

In some aspects, the techniques described herein relate to an interactive toy, wherein two of the at least three movement arms connect to the eye on an upper side of the eye, and wherein one of the at least three movement arms connects to the eye on a lower side of the eye.

In some aspects, the techniques described herein relate to an interactive toy, further comprising a fabric substrate covering the interactive toy, and wherein the eye is molded on the fabric substrate.

In some aspects, the techniques described herein relate to an interactive toy, wherein the eye deforms when changing from the first shape to the second shape.

BRIEF DESCRIPTION OF THE DRAWINGS

Various embodiments are depicted in the accompanying drawings for illustrative purposes and should in no way be interpreted as limiting the scope of the embodiments. In addition, various features of different disclosed embodiments can be combined to form additional embodiments, which are part of this disclosure.

DETAILED DESCRIPTION

The present description will be directed in particular to elements forming part of, or cooperating more directly with, apparatus and methods in accordance with the disclosure. It is to be understood that elements not specifically shown or described may take various forms well known to those skilled in the art.

Generally described, one or more aspects of the present disclosure correspond to an interactive toy that can manifest different facial expressions based on, for example, user interactions. More specifically, some aspects of the present disclosure relate to a plush toy that provides different facial expressions through various eye movements or varying eye shapes. Additionally, some disclosed embodiments further implement techniques that combine various eye movements with additional movements of other body parts (e.g., ears and head) of the plush toy. In some embodiments, the plush toy is programmable to operate under different modes, where some of the modes can be activated or de-activated through initial unpackaging by a user of the plush toy. In some embodiments, an accessory (e.g., a heart-shaped piece) can be assembled by a user unto the plush toy to initiate more interactive operations, such as responding to touching, sounding, putting down, and tickling by the user. Embodiments of the plush toy disclosed herein therefore provide a user (or player) or a group of users more interactive and satisfying user experience.

Although the various aspects will be described in accordance with illustrative embodiments and combination of features, one skilled in the relevant art will appreciate that the examples and combination of features are illustrative in nature and should not be construed as limiting. More specifically, aspects of the present application may be applicable with various types of toys, such as plush toys, dolls and the like. Still further, although a specific structure and assembly of a plush toy for providing interactive operations will be described, such illustrative plush toy design or structure should not be construed as limiting. Accordingly, one skilled in the relevant art will appreciate that the aspects of the present application are not necessarily limited to application to any particular type of toys or plush toys.

Figures 1A, 1B, 1C:
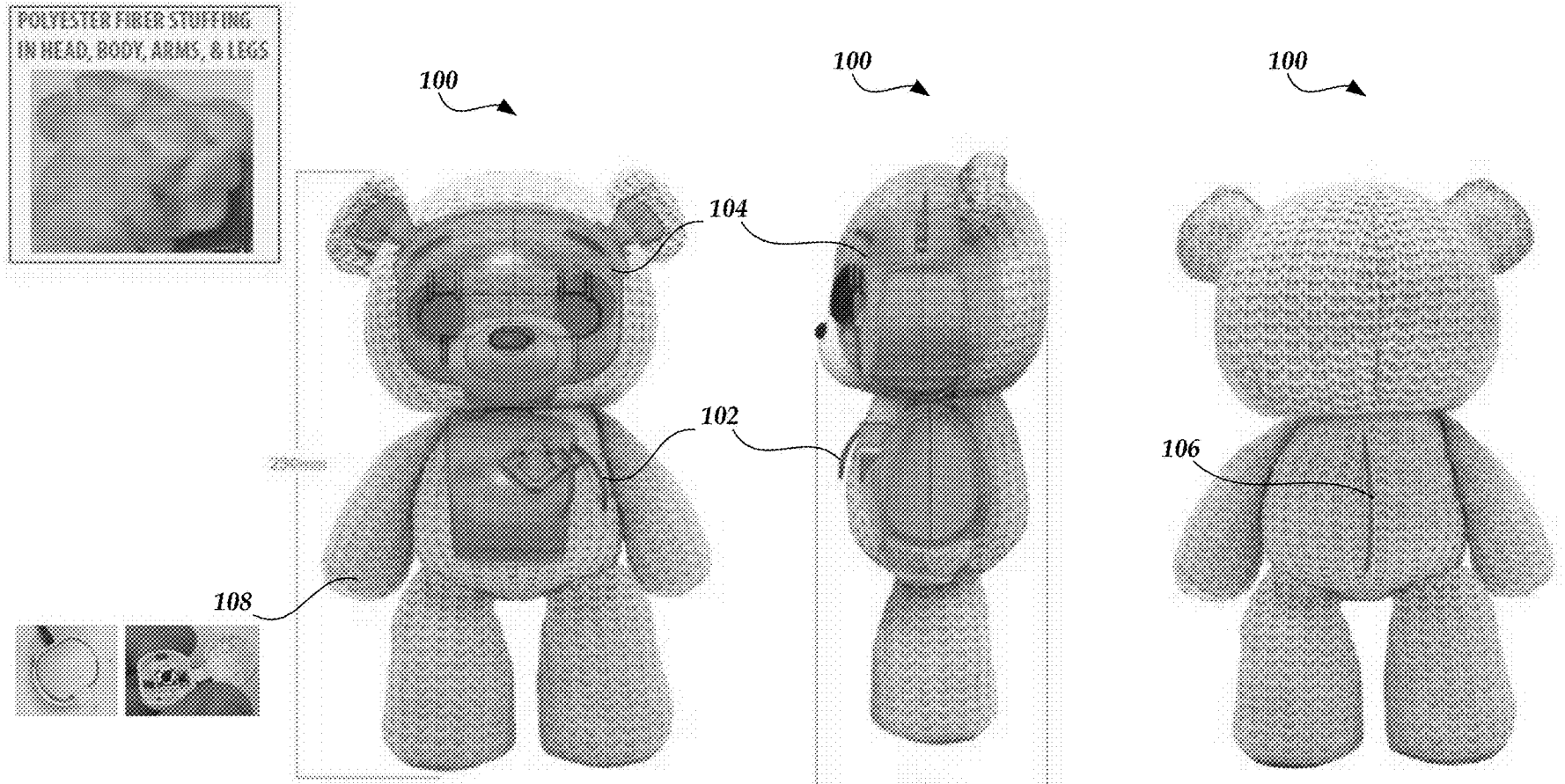
FIGS. 1A-1C illustrate various views of an example plush toy according to some embodiments of the present disclosure.

Referring to the figures, FIGS. 1A-1C illustrate various views of an example plush toy 100 according to some embodiments of the present disclosure. As illustrated in FIGS. 1A-1C, the plush toy 100 takes the form of a miniature bear at a miniaturized size. However, it should be noted that the plush toy 100 is not limited to the illustrated shape or size and can have any other shapes or sizes.

As shown in FIG. 1A, the plush toy 100 resembles a miniature bear having a height of 290 mm and a width of 190 mm (not illustrated in FIG. 1A) between two sides. As mentioned above, the plush toy 100 can have any other shapes or sizes. In some embodiments, weighted pellets may be stuffed in arms and legs of the plush toy 100. Further, a switch 108 may be embedded (e.g., not exposed to view) under one or both arms of the plush toy 100 for facilitating interactive operations with a user, which will be described in greater detail below. Additionally, in some embodiments, polyester fiber may be stuffed in the head, body, arms and legs of the plush toy 100. However, it should be noted that other materials may be used to stuff the interior of the plush toy 100.

As shown in FIG. 1A, a pair of threads 102 are hanging in front of the chest of the plush toy 100. In some embodiments, the pair of threads can be used to tie an accessory (e.g., a heart piece) to the plush toy 100 to initiate more interactive operations between a user and the plush toy 100 as discussed below. FIG. 1A also shows a housing 104 (hidden from view of a user) of the plush toy 100. In some embodiments, the housing accommodates mechanical or electrical components (not shown in FIG. 1A) that facilitate interactive operations (e.g., different facial expressions) of the plush toy 100 as will be discussed in greater detail below. In certain embodiments, the housing 104 comprises plastic. Of course the housing 104 can comprise other materials or more than one material and still fall within the scope of this disclosure.

As shown in FIG. 1B, the plush toy 100 has a thickness of 115 mm from the nose on the front side to the back of the head. However, it should be noted that the plush toy 100 may have any other suitable thickness. For example, in certain embodiments, the plush toy 100 has a thickness of 150 mm with all the final stuffing/padding. In other embodiments, the plush toy 100 can have a thickness of 140 mm, 160 mm, 170 mm, or any other thickness.

In some embodiments, the housing 104 has a compact size and shape to accommodate the mechanical or electrical components (not shown in FIG. 1B) needed for facilitating interactive operations. As such, the size, cost and weight of the plush toy 100 may be reduced.

FIG. 1C illustrates a back view of the plush toy 100. As shown in FIG. 1C, the plush toy 100 may have a velcro strip 106 on its back to allow a user to access one or more batteries that are utilized to power the plush toy 100. In some embodiments, the velcro strip 106 can allow a tether (not shown in FIG. 1C) to go through for tying the plush toy 100 to a package, which will be discussed in greater detail below with reference to FIGS. 10A-10B.

Figure 2:
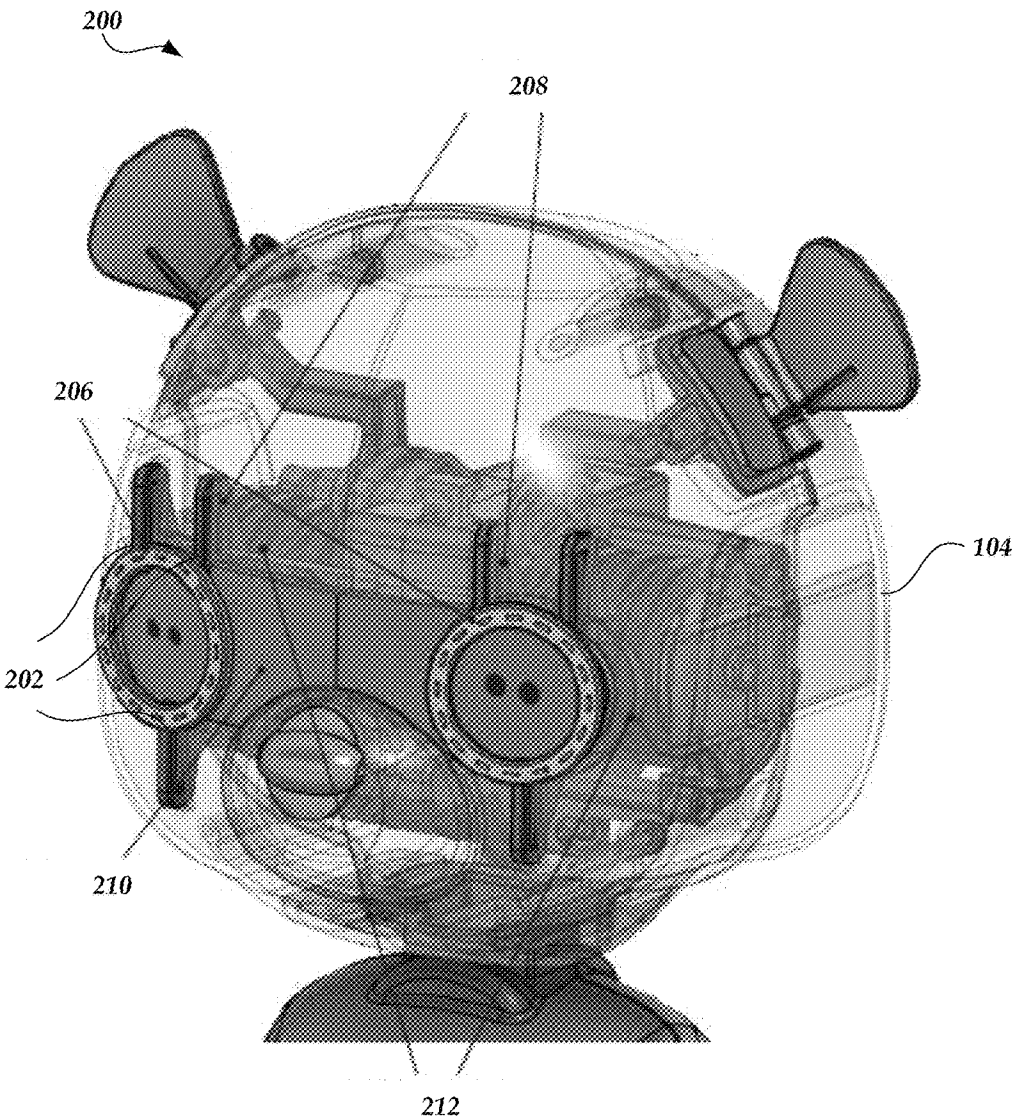
FIG. 2 is a front perspective view of an internal structure of the example plush toy illustrated in FIGS. 1A-1C.

FIG. 2 is a front perspective view of an internal structure 200 of the example plush toy 100 illustrated in FIGS. 1A-1C. Referring to FIG. 2, the internal structure 200 includes the housing 104, movement arms 208, eyes 206, eye plate 210, and rotating discs 212. As illustrated in FIG. 2, the movement arms 208, eyes 206, eye plate 210 are deployed on the surface of the housing 104 while the rotating discs 212 are accommodated within the housing 104. While the illustrated embodiments show the eyes 206 of the face as being the deforming part that changes shape, the disclosure is not so limited. In other embodiments, the nose, mouth, ear, eyebrow, and/or other facial features can be the deforming part alone or in combination with another deforming part (e.g., eyes).

In some embodiments, the eyes 206 are made of thermoplastic rubber (TPR). However, it should be noted that other materials that are deformable can be utilized to make the eyes 206.

As shown in FIG. 2, for each of the eyes 206, there are three attachment points 202 associated with the movement arms 208. In operations that will be illustrated below, as the movement arms 208 move up or down, the eyes 206 may be deformed (because of the moving up or down of the three attachment points 202) into different shapes to provide different facial expressions of the plush toy 100 through eye movements or varying eye shapes. Although three attachment points 202 are associated with each of the eyes 206, it should be noted that other number of attachment points 202 may be associated with each of the eyes 206.

Figure 3:
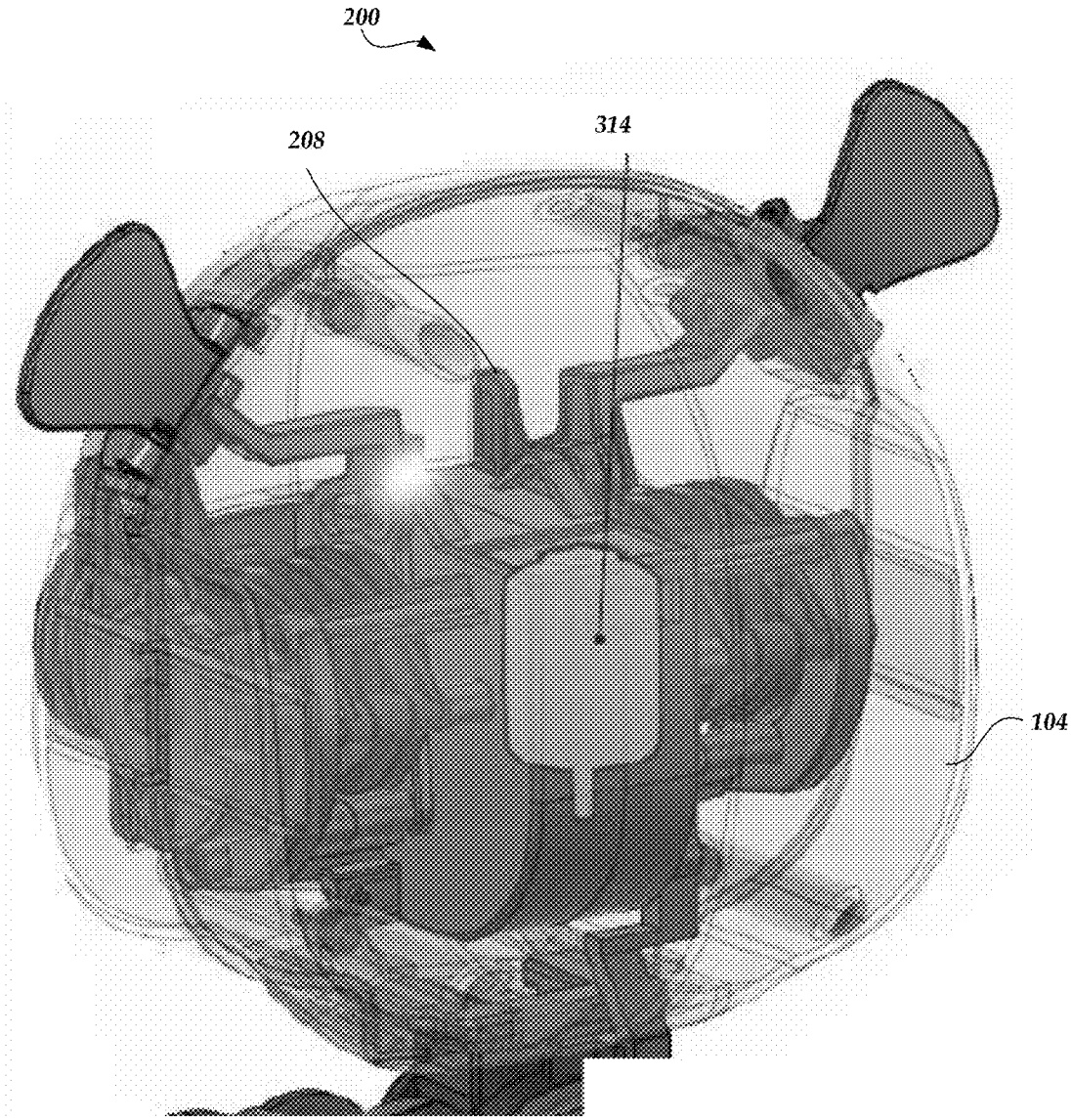
FIG. 3 is a back perspective view of the internal structure of FIG. 2.

FIG. 3 shows a back perspective view of the internal structure 200. As illustrated in FIG. 3, a motor 314 is housed within the housing 104. In operation, the motor 314 may drive movements of the eyes 206 of the plush toy 100 to switch between different facial expressions. Specifically, the motor 314 may power rotational movements (e.g., rotating forward or backward) of the rotating discs 212, which in turn will cause the movement arms 208 to move up or move down, thereby deforming the eyes 206 into different shapes to accomplish different facial expressions through eye movements.

Figure 4B:
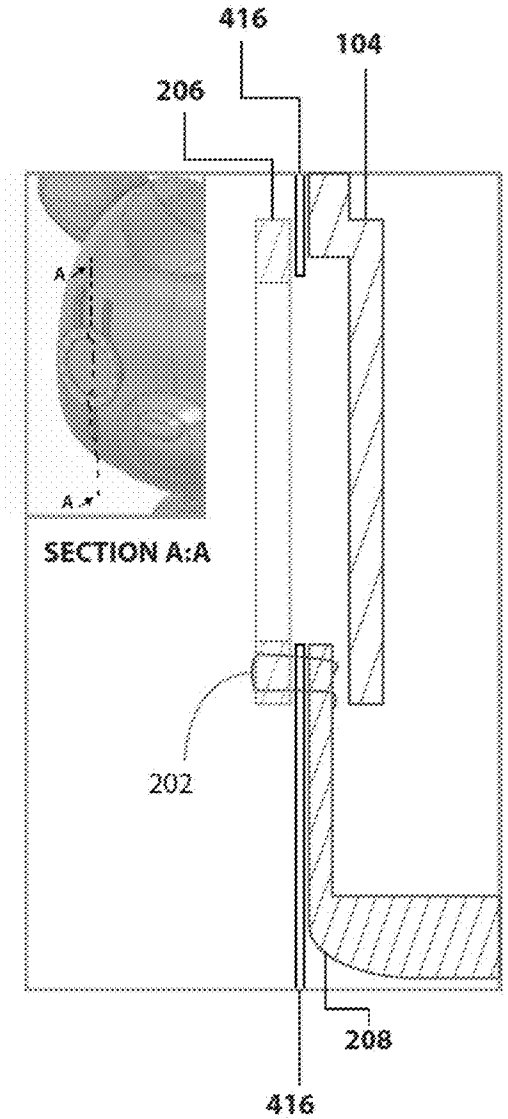
FIG. 4B illustrates a cross-section schematic of parts of the internal structure of FIG. 2.
Figure 4A:
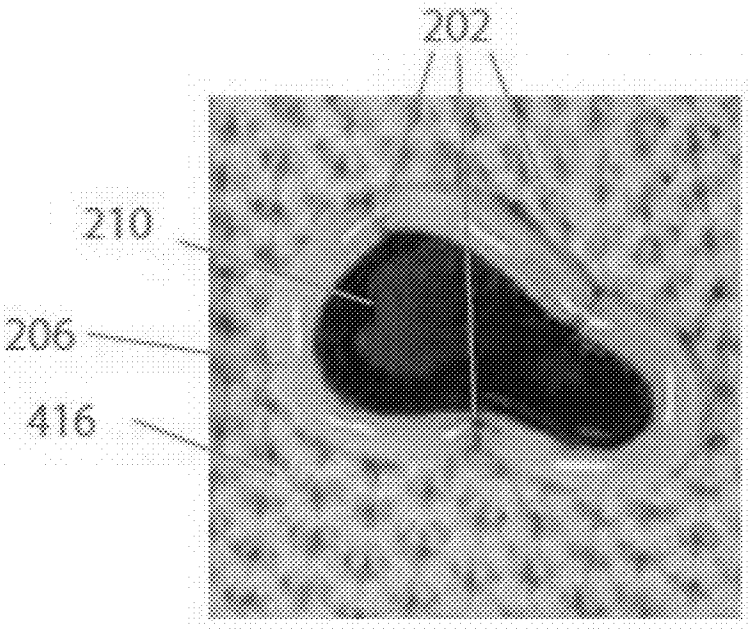
FIG. 4A illustrates components around an eye of the example plush toy illustrated in FIGS. 1A-1C.

FIG. 4A illustrates a perspective view of parts of the plush toy 100 of FIGS. 1A-1C around the eyes 206. Specifically, FIG. 4 shows the eye plate 210, the eyes 206, the attachment points 202, and the fabric 416 surrounding the eyes 206.

FIG. 4B illustrates a cross-section schematic of parts of the internal structure 200 of FIG. 2. Specifically, FIG. 4B shows a schematic view along the section A to A associated with the internal structure 200. Shown in FIG. 4B is a part of the housing 104, the fabric 416, the eyes 206, one movement arm 208, and one attachment point 202.

Figure 5:
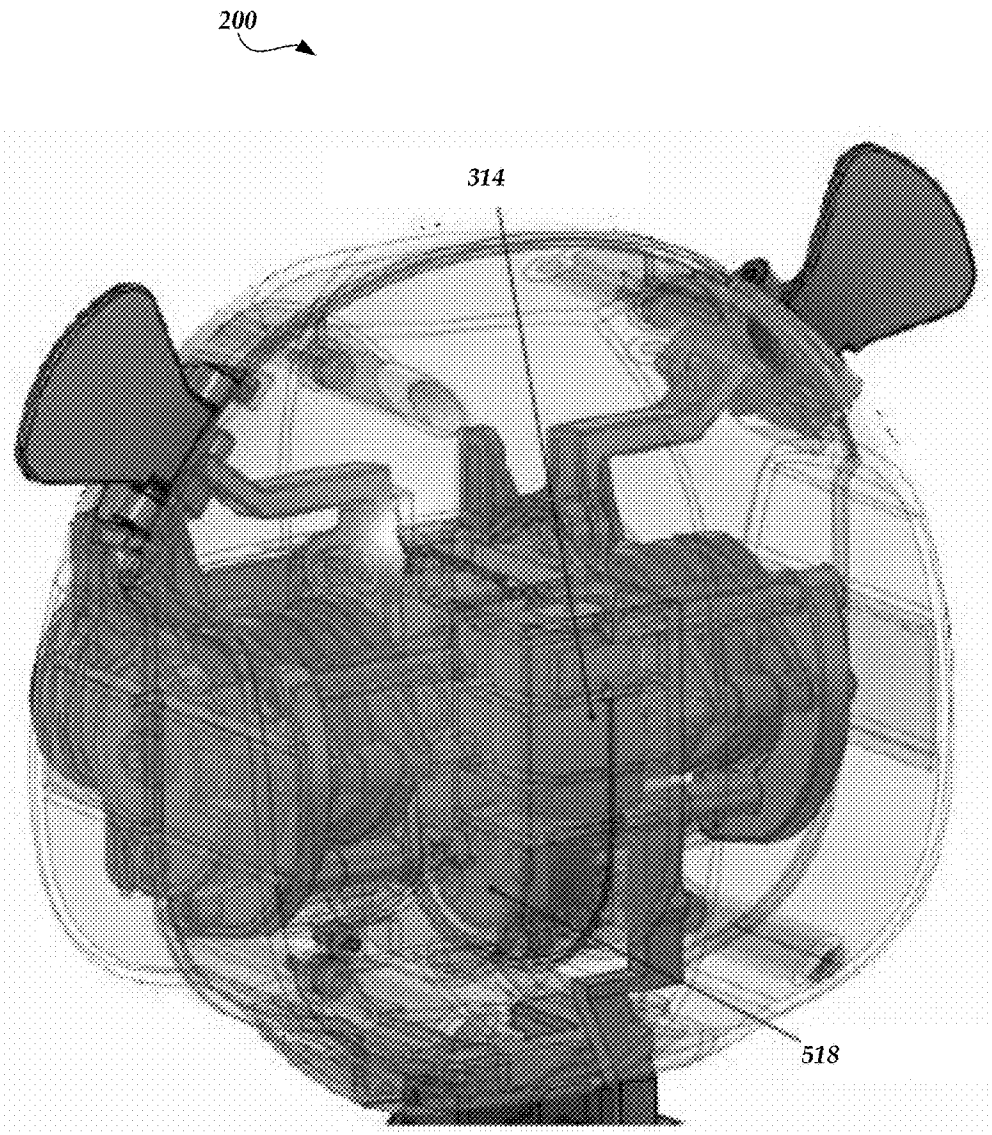
FIG. 5 is another back perspective view of the internal structure of FIG. 2.

FIG. 5 shows another back perspective view of the internal structure 200 of FIG. 2. As shown in FIG. 5, the internal structure 200 includes the housing 104, the motor 314 and the gearbox 518. In some embodiments, the motor 314 and the gearbox 518 are disposed within the housing 104, which provides protection to the motor 314 and the gearbox 518. Although not readily observed from FIG. 5, the motor 314 may be connected to the gearbox 518. In some embodiments, the gearbox 518 may provide one or more gears. In some embodiments, some inputs from a user may trigger the motor 314 to run, which in turn will cause the one or more gears of the gearbox 518 to turn clockwise or counter-clockwise. The movement of the one or more gears of the gearbox 518 may then cause one or more rotating discs 212 to rotate.

Figure 6:
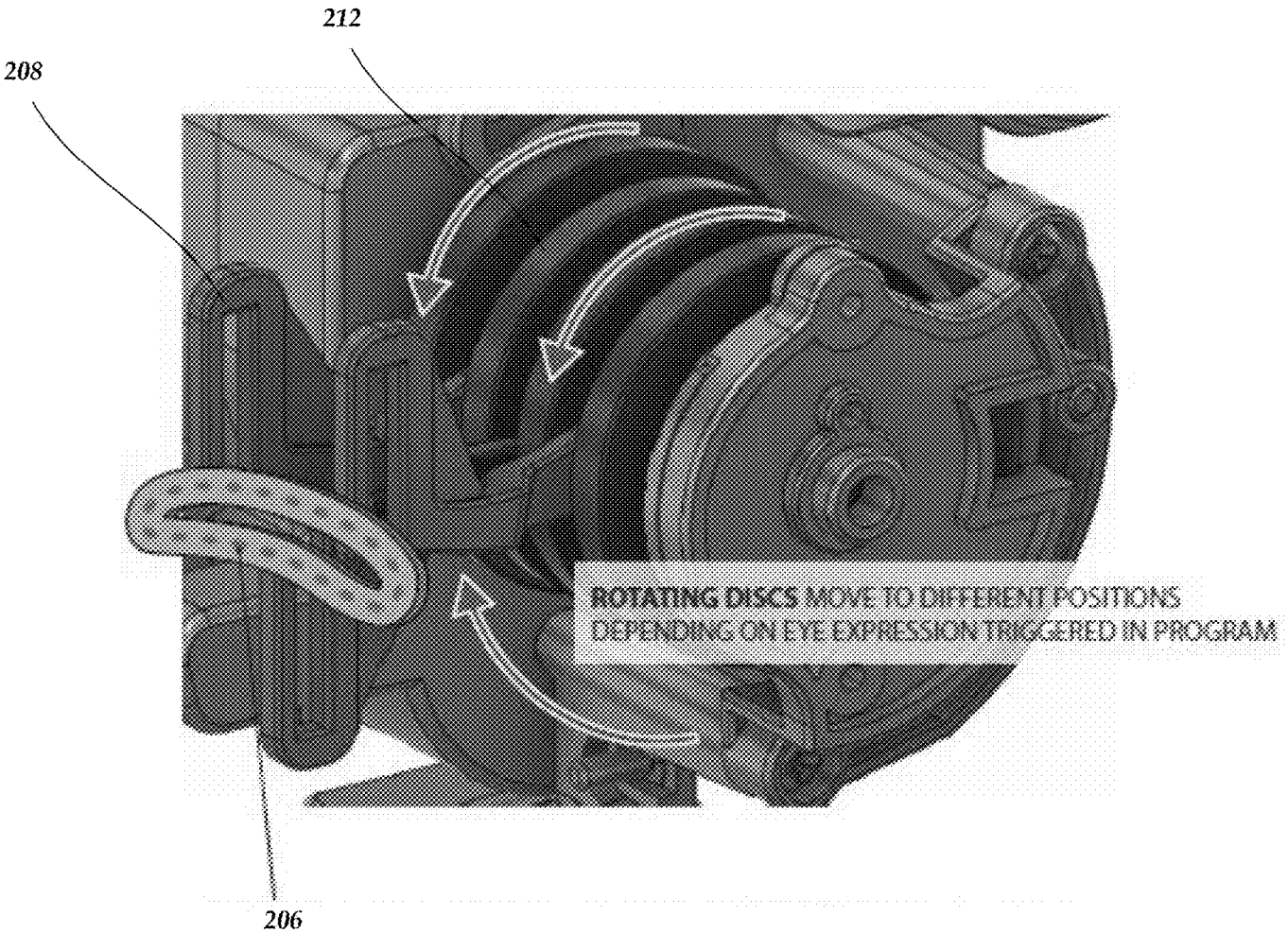
FIG. 6 is an expanded view showing portions of the internal structure of FIG. 2 in operation.

FIG. 6 is an expanded view showing portions of the internal structure 200 of FIG. 2 in operation. Specifically, FIG. 6 illustrates the movement of the rotating discs 212, which can be caused by the operation of the motor 314 and gearbox 518 of FIG. 5. In some examples, the motor 314 may be programmed to run specified turns so as to create different combinations of positions for the rotating discs 212 and the movement arms 208, thereby causing different facial expressions due to different eye movements. For example, certain operation from a user may cause the motor 314 to run in a way such that the movement arms 208 are configured to the positions illustrated in FIG. 6, deforming the eyes through movements into a shape resembling an expression of "blink" of eyes.

Figure 7:
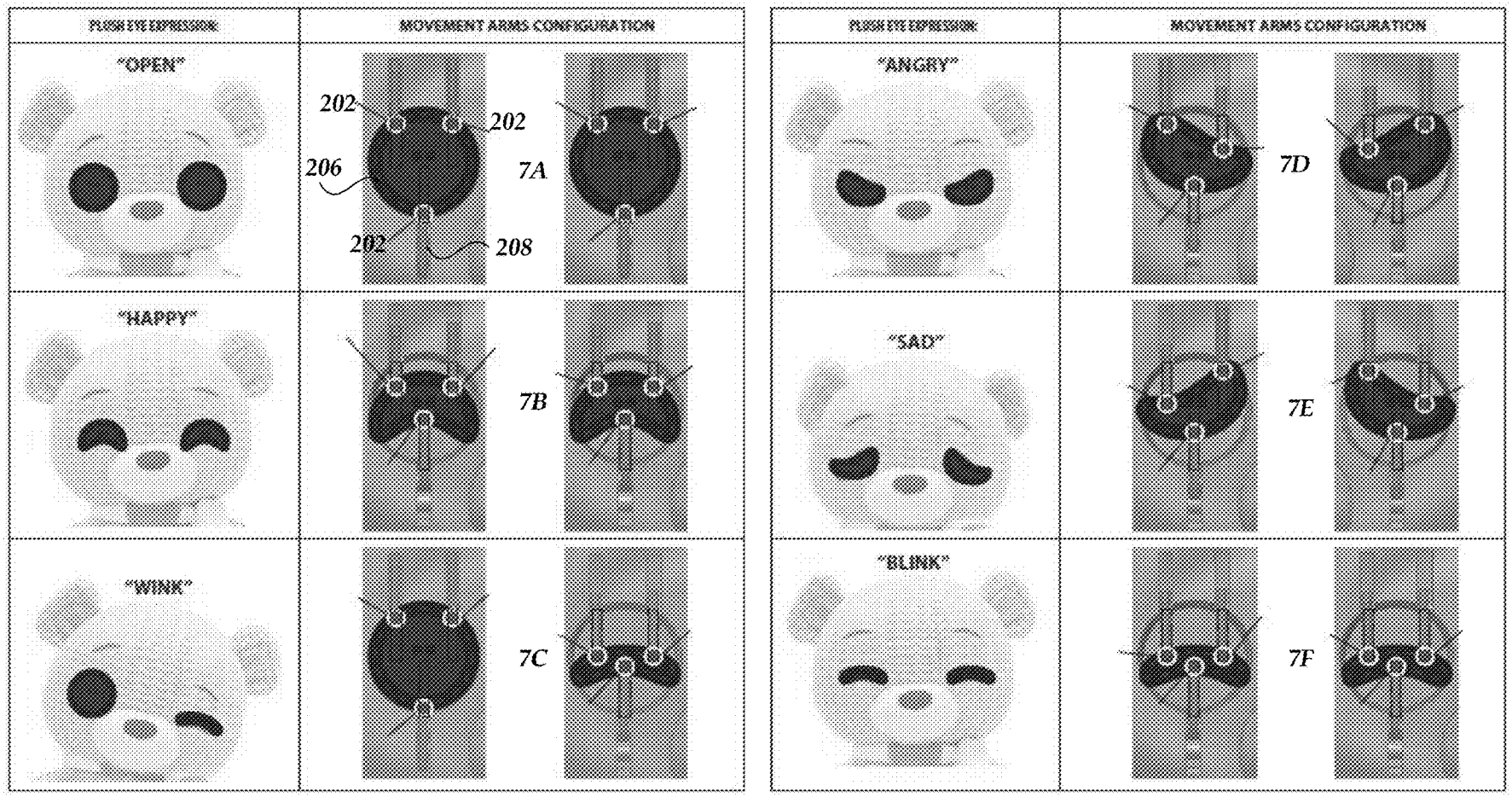
FIG. 7 shows different facial expressions of the example plush toy of FIGS. 1A-1C under different operating configurations of the internal structure of FIG. 2.

Moving to FIG. 7, embodiments of different facial expressions provided by the plush toy 100 of FIGS. 1A-1C based on different positions of three movement arms 208 associated with eyes 206 (e.g., a left eye 206 and a right eye 206) are depicted. Shown on the top left is the facial expression ("OPEN") in which the eyes 206 are fully open. The "OPEN" expression can be achieved by configuring the movement arms 208 to the configuration 7A. In some examples, the configuration 7A can be obtained when the plush toy 100 receives specific input (e.g., touch certain sensors on certain parts of the plush toy 100 and turn on certain switches of the plush toy 100) that causes the motor 314 to run a specified number of turns.

Shown on the center left is the facial expression ("HAPPY") in which both eyes 206 are not fully open or both open to a degree slightly less than the "OPEN" expression. The "HAPPY" expression can be achieved by configuring the movement arms 208 to the configuration 7B. In some examples, the configuration 7B can be obtained when the plush toy 100 receives specific input that causes the motor 314 to run a specified number of turns, similar to how the configuration 7A is obtained.

Shown on the bottom left is the facial expression ("WINK") in which one of the eyes 206 are little open and the other of the eyes 206 are fully open. The "WINK" expression can be achieved by configuring the movement arms 208 to the configuration 7C. In some examples, the configuration 7C can be obtained when the plush toy 100 receives specific input that causes the motor 314 to run a specified number of turns, similar to how the configuration 7A or 7B is obtained.

Shown on the top right is the facial expression ("ANGRY") in which the eyes 206 are close a little bit downward. The "ANGRY" expression can be achieved by configuring the movement arms 208 to the configuration 7D. In some examples, the configuration 7D can be obtained when the plush toy 100 receives specific input (e.g., touch certain sensors on certain parts of the plush toy 100 and turn on certain switches of the plush toy 100) that causes the motor 314 to run a specified number of turns, similar to how the configuration 7A-7C are obtained.

Shown on the center right is the facial expression ("SAD") in which both eyes 206 are not fully open or both open to a degree slightly less than the "OPEN" expression. The "SAD" expression can be achieved by configuring the movement arms 208 to the configuration 7E. In some examples, the configuration 7E can be obtained when the plush toy 100 receives specific input that causes the motor 314 to run a specified number of turns, similar to how the configurations 7A-7D are obtained.

Shown on the bottom right is the facial expression ("BLINK") in which one of the eyes 206 are little open and the other of the eyes 206 are fully open. The "BLINK" expression can be achieved by configuring the movement arms 208 to the configuration 7F. In some examples, the configuration 7F can be obtained when the plush toy 100 receives specific input that causes the motor 314 to run a specified number of turns, similar to how the configurations 7A-7E are obtained.

Figure 8:
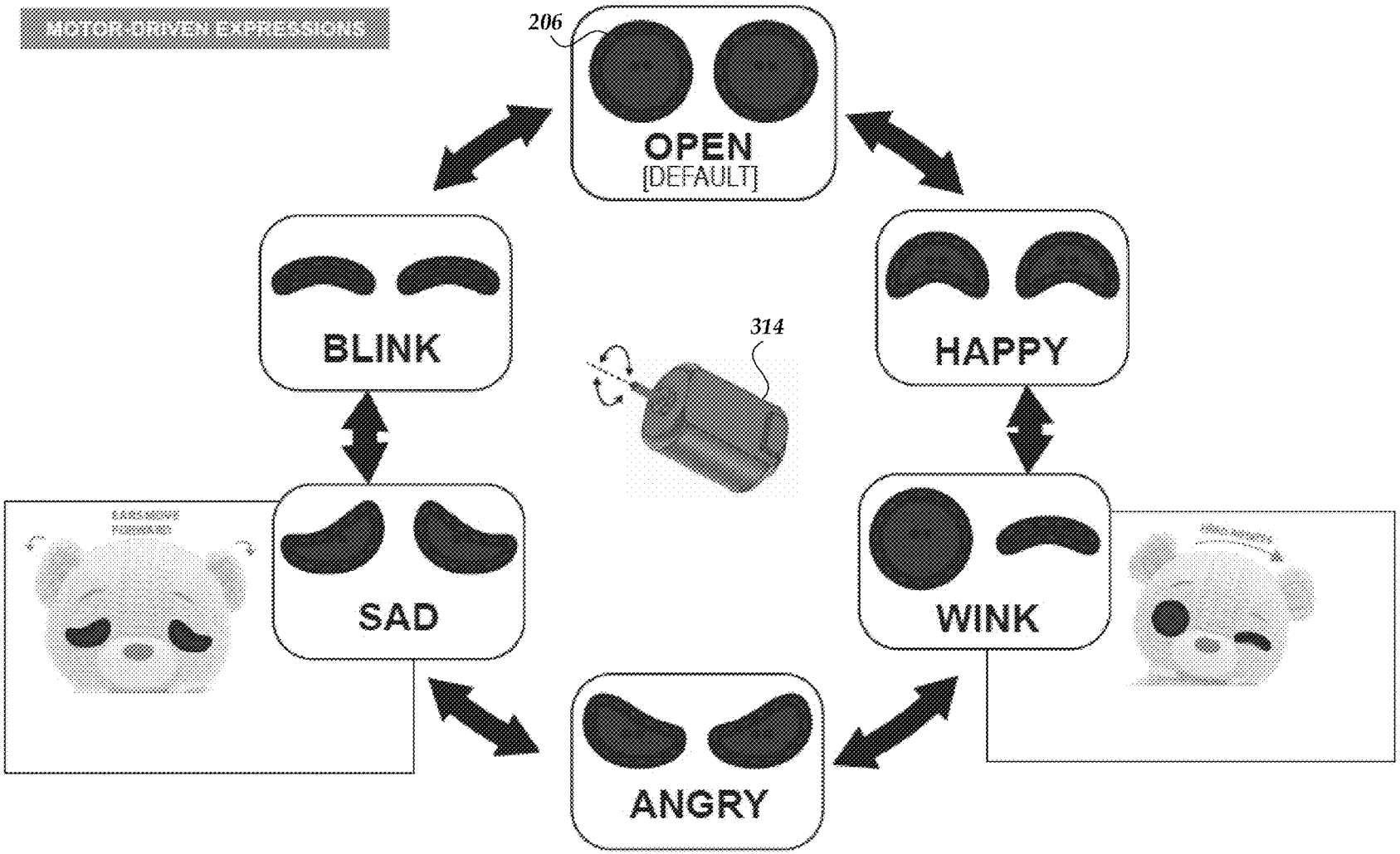
FIG. 8 illustrates an example expression transition cycle of the example plush toy illustrated in FIGS. 1A-1C.

FIG. 8 illustrates an example expression transition cycle of the example plush toy 100 illustrated in FIGS. 1A-1C. As illustrated in FIG. 8, different expressions of the example plush toy 100 may correspond to different eye movements, eye shapes or deformations of the eyes 206. In certain embodiments, deformations of the eyes 206 can be driven by the motor 314. The rotation of the motor 314 may be controlled by a controller (not shown in FIG. 8) according to a program executable by the controller. Specifically, the controller may control how many turns the motor 314 is to run or rotate based on different user interactions. The number of turns the motor 314 rotates may then affect how the rotating discs 212 rotate (e.g., the number of degrees the rotating discs 212 rotates), which may affect the positions of the movement arms 208 and the attachment points 202, thereby causing the eyes 206 to be deformed into various shapes as illustrated in FIG. 8.

As shown in FIG. 8, the example plush toy 100 may start with a default expression "OPEN" where the eyes 206 open in a shape similar to or the same as circles. In some embodiments, when the motor 314 is programmed to rotate clockwise, the next expression that the plush toy 100 may manifest is the "HAPPY" expression, where both eyes 206 are deformed to a certain degree and open less than the "OPEN" expression. As the motor 314 continues to rotate clockwise, the expressions that the example plush toy 100 may manifest are "WINK," "ANGRY," "SAD," "BLINK," and then returning back to "OPEN."

In some embodiments, when the motor 314 is programmed to rotate counter clockwise, the next expression from the default "OPEN" expression is the "BLINK" expression, where both eye 206 are deformed and open less than the "OPEN" and the "HAPPY" expression. As the motor 314 continues to rotate clockwise, the expressions that the example plush toy 100 may manifest are "SAD," "ANGRY," "WINK," "HAPPY," and then returning back to "OPEN", for example.

In some embodiments, when a user touches a first sensor (e.g., a capacitive sensor on a portion of the head or other location of the example plush toy 100, not shown in FIG. 8) of the example plush toy 100 once, the eyes 206 may deform from "OPEN" to "HAPPY." When the user touches the first sensor once again (e.g., touch for the second time), the eyes 206 may deform from "HAPPY" to "WINK". When the user touches the first sensor once again (e.g., touch for the third time), the eyes 206 may deform from "WINK" directly to "ANGRY." When the user touches the first sensor once again (e.g., touch for the fourth time), the eyes 206 may deform from "ANGRY" to "SAD." When the user touches the first sensor once again (e.g., touch for the fifth time), the eyes 206 may deform from "SAD" to "BLINK." When the user touches the first sensor once again (e.g., touch for the sixth time), the eyes 206 may deform from "BLINK" to "OPEN."

In some embodiments, when a user touches a first sensor (e.g., a capacitive sensor on a portion of the head of the example plush toy 100, not shown in FIG. 8) of the example plush toy 100 once, the eyes 206 may deform from "OPEN" to "HAPPY." In other embodiments, when a user touches the first sensor once, the eyes 206 may deform from "OPEN" to "WINK" directly (e.g., without staying at the "HAPPY" expression). In other embodiments, when a user touches the first sensor once, the eyes 206 may deform from "OPEN" directly to "ANGRY." In still other embodiments, when a user touches the first sensor once, the eyes 206 may deform from "OPEN" to "SAD" directly. In yet other embodiments, when a user touches the first sensor once, the eyes 206 may deform from "OPEN" to "BLINK" directly.

In some embodiments, some or all movements of the eyes 206 can be paired with certain movements of other body parts (e.g., head, ear, eyebrows, mouth, nose, or the like) of the example plush toy 100. As illustrated in FIG. 8, in some embodiments, the "WINK" expression can be paired with a movement of the example plush toy 100. More specifically, when the example plush toy 100 manifests the "WINK" expression, the example plush toy 100 may also tilt or rotate its head in one direction. In some embodiments, the "SAD" expression can be paired with a movement of the ears of the example plush toy 100. More specifically, when the example plush toy 100 manifests the "SAD" expression, the example plush toy 100 may also flip or move its ears forward.

Figures 9A, 9B:
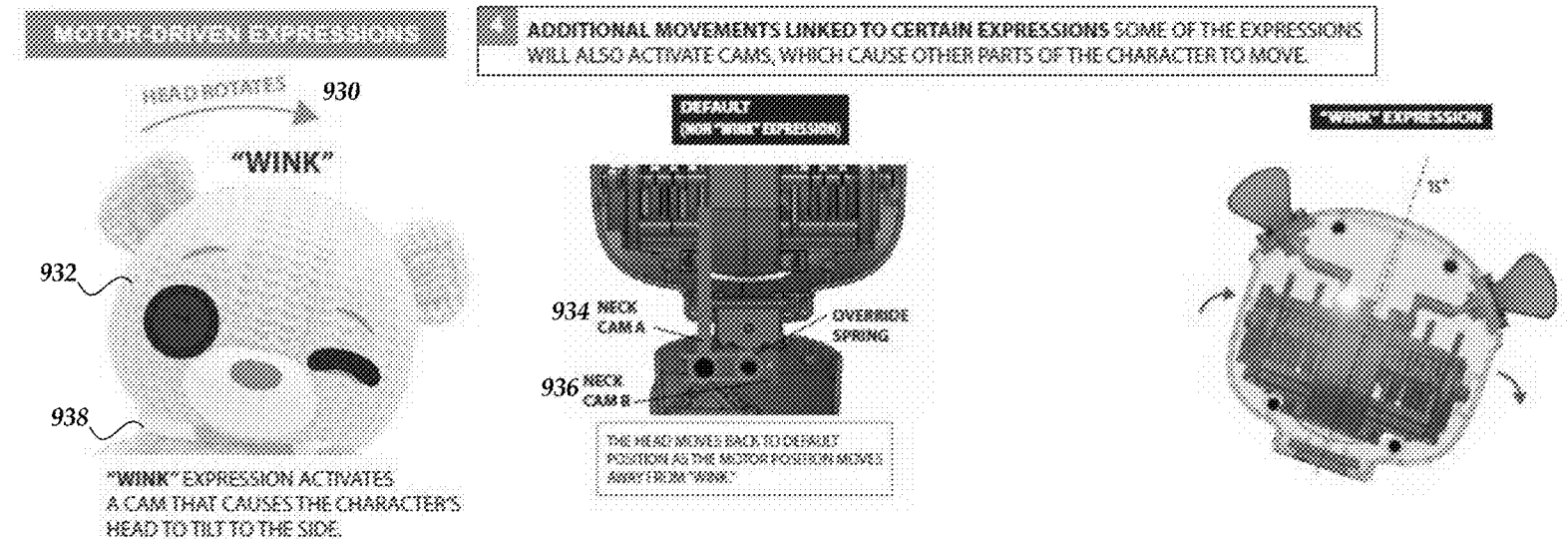
FIGS. 9A-9B illustrate different movements of a plush toy linked to different facial expressions of the plush toy under different configurations of an internal structure of the plush toy.

FIGS. 9A-9B illustrates example implementations for combining different facial expressions with different movements of body parts of the example plush toy of FIG. 1. FIG. 9A illustrates the "WINK" expression of the example plush toy 100 is combined with a head rotation or tilt in one direction. For example, when the example plush toy 100 manifests the "WINK" expression, one or more CAMS (e.g., rotating or sliding components that can transform rotary motion into linear motion) are activated, causing the head 932 of the example plush toy 100 to tilt or rotates in the direction 930 as shown. Specifically, when the example plush toy 100 shows the "WINK" expression, the neck CAM A 934 and neck CAM B 936 in the middle of FIG. 9A are activated to rotate, resulting in a linear motion around the neck 938 of the example plush toy 100. As such, the head 932 of the example plush toy tilts about 15 degrees as indicated in the right of FIG. 9A.

FIG. 9B illustrates the "SAD" expression of the example plush toy 100 is combined with movements of the ears 940. Specifically, when the example plush toy 100 manifests the "SAD" expression, the CAM 942 is activated, causing the ears 940 of the example plush toy 100 to flip or move away from the default positions of the ears 940 and move forward as shown in the middle of FIG. 9B. In some examples, when the example plush toy 100 switches from the "SAD" expression to other expressions (e.g., "WINK," "HAPPY," "BLINK," or "OPEN"), the CAM 942 will also be activated but moves in another direction to cause the ears 940 to rotate backward to the default positions of the ears 940.

Although not illustrated in FIGS. 9A-9B, in some embodiments, other combinations of different eye movements with different body parts movements can be implemented by the example plush toy 100. For example, when the expression changes from "OPEN" TO "HAPPY", the eyebrows 944 may move upward from default positions of the eyebrows 944. As another example, when the example plush toy 100 shows the "SAD" expression, the head 932 can move forward around the neck 938 to result in a body movement where the face of the example plush toy 100 appears to look downward. It should be noted that other kinds of combinations of facial expressions and body movements not specifically discussed here can also be implemented by the example plush toy 100 and should not be construed to fall outside the scope of the present disclosure.

Figures 10A, 10B:
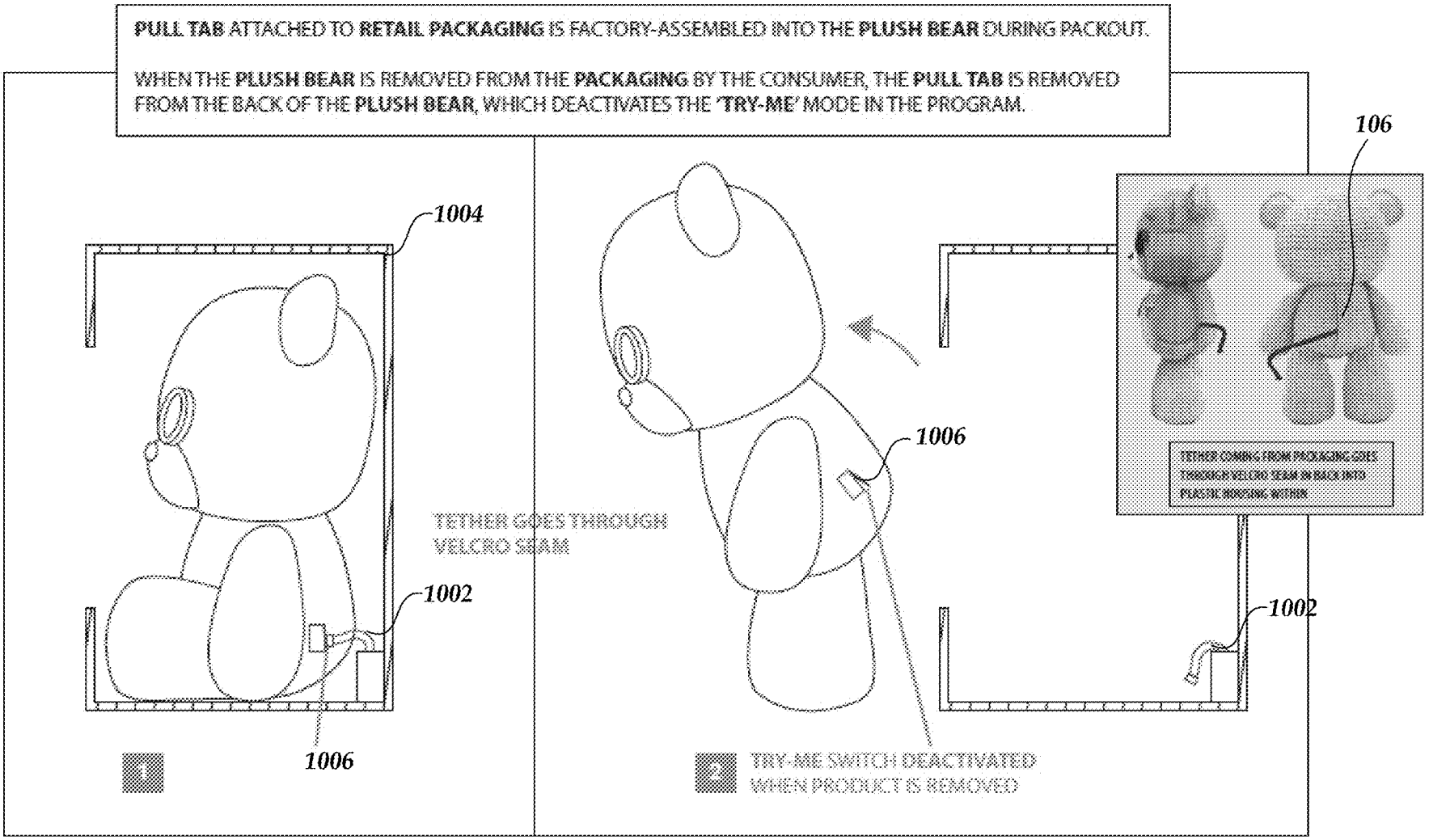
FIG. 10A shows an example retail package of a plush toy in accordance with some embodiments of the present disclosure.
FIG. 10B shows removal of the plush toy from the example retail package of FIG. 10A to deactivate a mode of operation of the plush toy in accordance with some embodiments of the present disclosure.

FIGS. 10A-10B illustrate an example package of a plush toy, such as the plush toy 100, and removal of the plush toy to activate or deactivate one or more modes of operation of the plush toy in accordance with some embodiments of the present disclosure. As shown in FIG. 10A, the plush toy 100 is packed in a package 1004, where a tether 1002 goes through the velcro strip 106 of the plush toy 100 to tie a try-me micro switch 1006 of the plush toy 100 to the package 1004. When the plush toy 100 is packaged as shown in FIG. 10A, the plush toy 100 will be in a try-me mode, where limited interactions between a potential buyer/user and the plush toy 100 may be allowed. In some embodiments, the limited interactions may display a sound in response to a user input and the plush toy 100 will not show different facial expressions or exhibit different body movements. In some embodiments, when the plush toy 100 is in the try-me mode, only some of the sensors (not shown in FIG. 10A) of the plush toy 100 may be activated. Thus, the plush toy 100 may not respond to certain user contacts or touches on some of the sensors. Advantageously, the try-me mode may save the power consumption of the plush toy 100.

FIG. 10B illustrates the removal of the plush toy 100 from the package 1004 by removing the tether 1002 from the back of the plush toy 100. In some embodiments, when the plush toy 100 is removed from the package 1004 and the tether 1002 is no longer tied to the try-me micro switch 1006 of the plush toy 100, the try-me mode may be deactivated. More specifically, in some examples, a pull tab (not shown in FIG. 10B) may be removed from the plush toy 100 when the tether 1002 is removed from the plush toy 100. The removal of the pull tab can be detected by a controller (not shown in FIG. 10B) of the plush toy 100 to trigger the deactivation of the try-me mode. As such, instead of experiencing limited interactions, a user may engage in more interactions with the plush toy 100.

Figure 11:
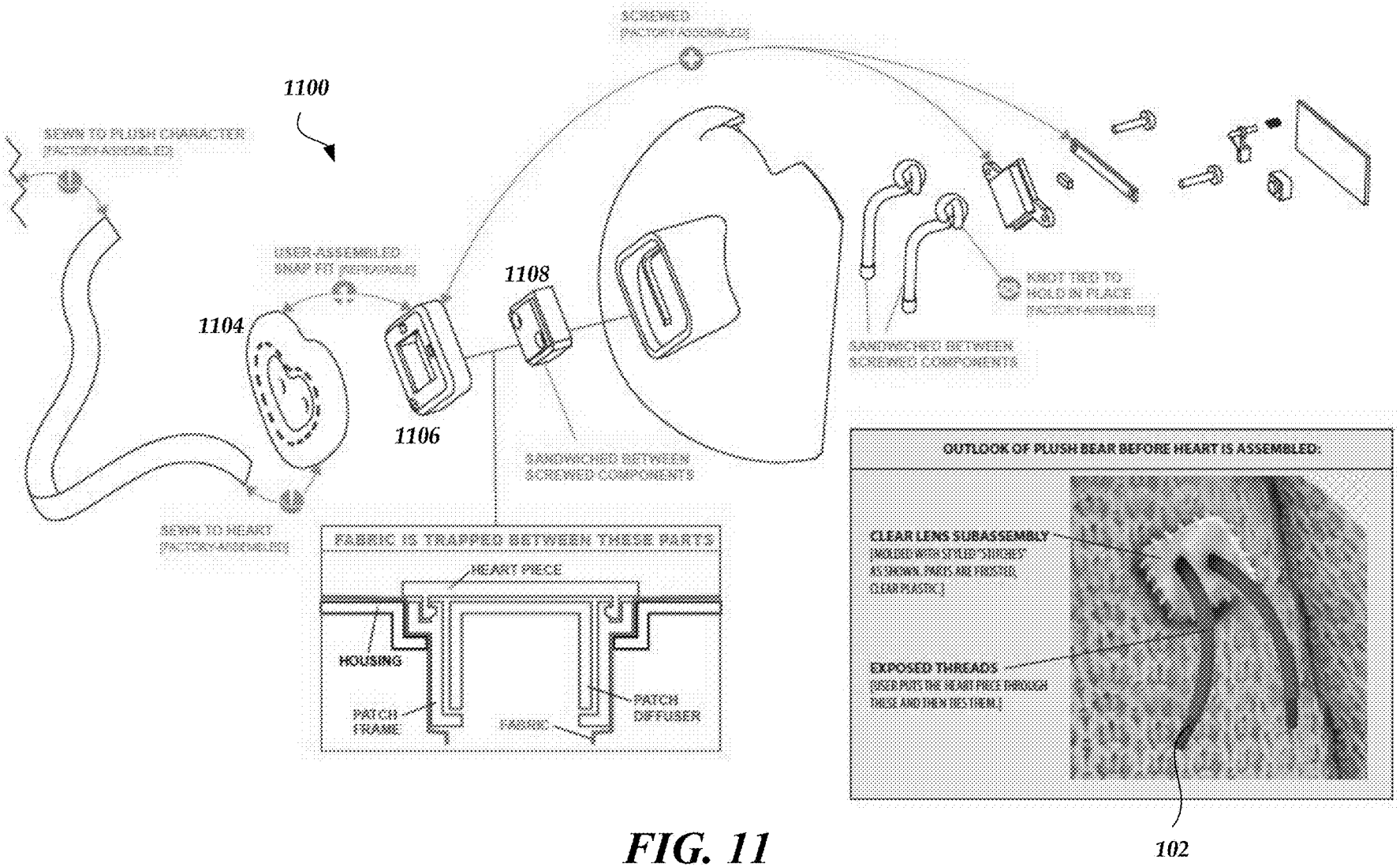
FIG. 11 is an exploded view of a heart piece accessory of the example plush toy of FIGS. 1A-1C.

FIG. 11 illustrates an exploded view of a heart piece accessory 1100 along with components (e.g., the heart shape 1104, the frame 1106 or the heart micro switch 1108) of the heart piece accessory 1100 of a plush toy, such as the plush toy 100 of FIGS. 1A-1C. In some examples, parts of the heart piece accessory 1100 can be assembled by the user of the plush toy 100 by putting components of the heart piece accessory 1100 together (e.g., fitting the frame 1106 into the heart shape 1104). In some examples, other components (e.g., the heart micro switch 1108 and the frame 1106) of the heart piece accessory 1100 can be assembled by the manufacturer of the plush toy 100. In some examples, after components of the heart piece accessory 1100 are assembled together, a user may tic the heart piece accessory 1100 to the plush toy 100 by using the threads 102. In some examples, after the heart piece accessory 1100 is tied to the plush toy 100, more interactive operations can be activated by a user by turning on the heart micro switch 1108. In these examples, the user may be able to engage in at most limited interactions with the plush toy 100 before the heart micro switch 1108 is turned on.

Figure 12:
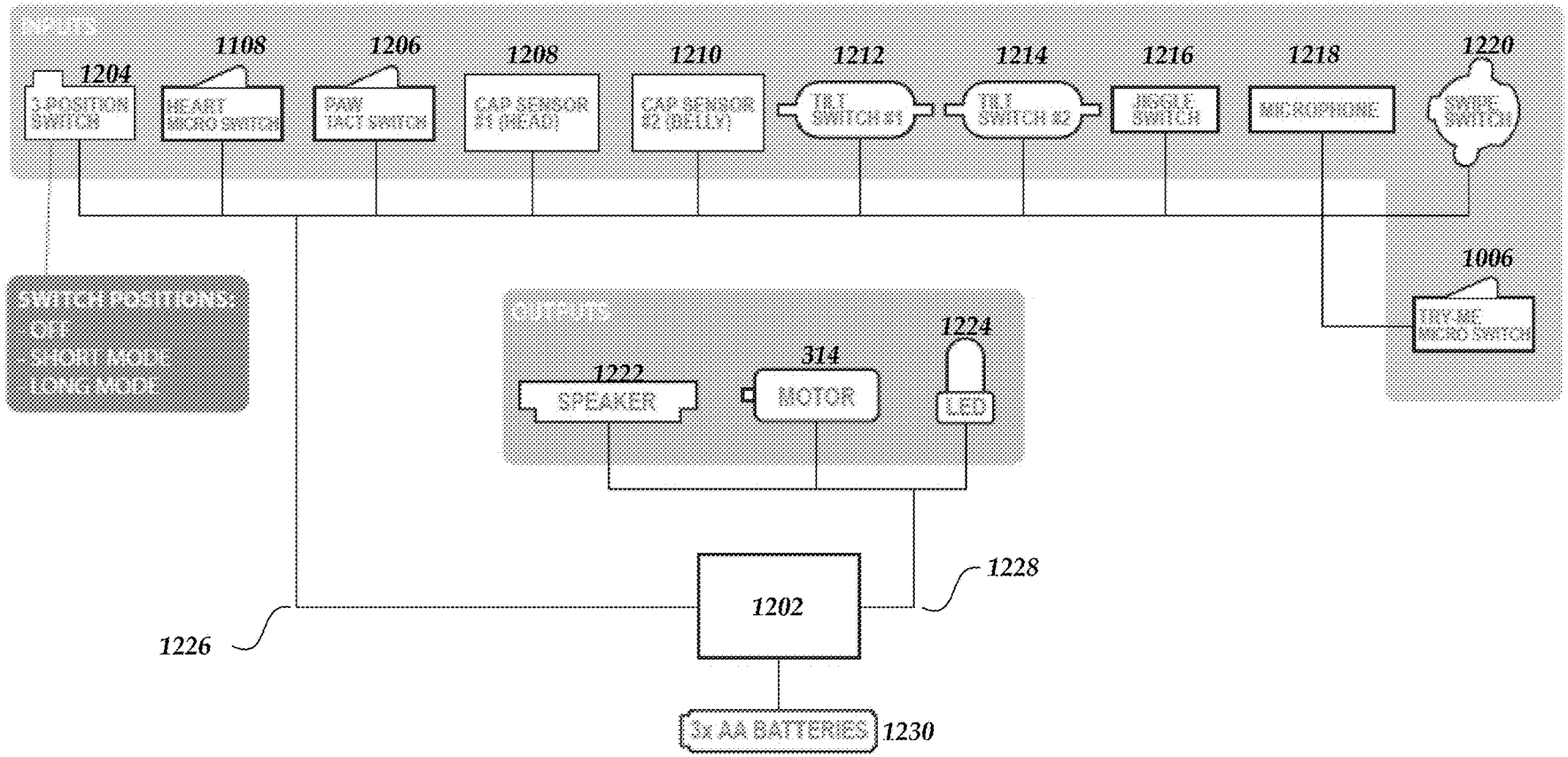
FIG. 12 schematically illustrates components of a plush toy, such as the example plush toy of FIG. 1, for providing interactive user experience.

FIG. 12 schematically illustrates components of a plush toy, such as the plush toy 100, 2000 (e.g., internal structures 200, 300, 2200), for providing interactive user experience. As explained below, the components and features from different embodiments disclosed herein can be combined in different ways while still falling within the scope of this disclosure.

As shown in FIG. 12, the 100, 2000 (e.g., internal structures 200, 300, 2200) may have some input components, some output components, a controller 1202, and a power source 1230 (e.g., AA batteries). The input components may include a 3-position switch 1204, a heart micro switch 1108, a paw tact switch 1206, a cap (capacitive) sensor 1208, a cap sensor 1210, a tilt switch 1212, a tilt switch 1214, a jiggle switch 1216, a microphone 1218, a swipe switch 1220, a try-me micro switch 1006. The output components may include a speaker 1222, a motor 314, a light-emitting diode (LED) 1224. In operations, as discussed above and will be discussed below, different input components and output components can coordinate together with the controller 1202 to provide different interactions with a user.

In some embodiments, the controller 1202 can be a motion control microcontroller (MCU). In these embodiments, the controller 1202 can include memory modules, communication interfaces and can process electrical signals 1226 received from the input components, such as the 3-position switch 1204, the heart micro switch 1108, the paw tact switch 1206, the cap sensor 1208, the cap sensor 1210, the tilt switch 1212, the tilt switch 1214, the jiggle switch 1216, the microphone 1218, the swipe switch 1220, the try-me micro switch 1006. Based on the electrical signals 1226 received, the controller 1202 can generate control signals 1228 to trigger the output components such as the speaker 1222, the motor 314, and the LED 1224 to perform different operations.

Figure 13:
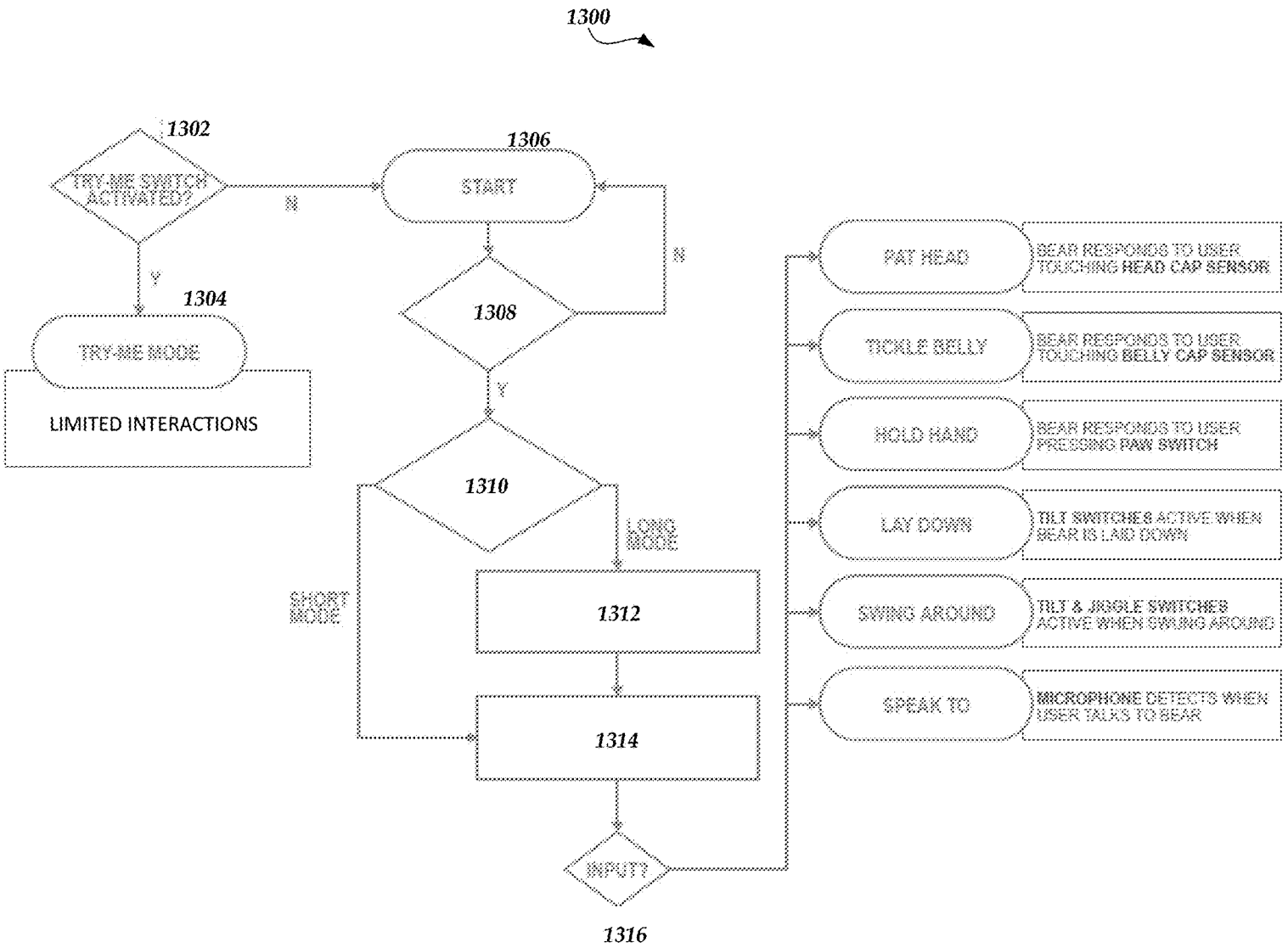
FIG. 13 is a flowchart illustrating operations of a plush toy, such as the example plush toy of FIGS. 1A-1C.

With reference to FIG. 13, an illustrative routine 1300 for activating and providing interactive user experience between a user and a toy will be described. The routine 1300 may be implemented, for example, by the example plush toy 100 of FIGS. 1A-1C. As described above, the routine 1300 can provide for interactive user experience between a user and the plush toy 100 through showing different facial expressions along with different body movements in response to different user inputs.

The routine 1300 begins at block 1302, where the controller 1202 of the example plush toy 100 evaluates if a try-me micro switch 1006 (not shown in FIG. 13) is turned on or activated. In some examples, the try-me micro switch 1006 may be activated when the plush toy 100 is not removed from the package 1004, as illustrated in FIG. 10A. In these examples, the block 1302 evaluates as "Y" (e.g., "Yes") and the routine 1300 proceeds to block 1304, where the plush toy 100 will be in a try-me mode. In some examples, the try-me mode may allow limited interactions between the plush toy 100 and a potential buyer. For example, in the try-me mode, the plush toy 100 may respond to only one kind of input from the user and respond in one way. Specifically, in the try-me mode, the plush toy 100 may activate only the cap sensor 1208 (not shown in FIG. 13) and display a sound through the speaker 1222 (not shown in FIG. 13) in response to a user touching the cap sensor 1208.

In some embodiments, the try-me micro switch 1006 may be deactivated when the plush toy is removed from the package 1004, as illustrated in FIG. 10B. In these embodiments, the block 1302 evaluates as "N" (e.g., "No") meaning the try-me micro switch 1006 is no longer activated, and the routine 1300 may proceed to blocks 1306 and 1308 where more interactions between the plush toy 100 and a user may be conducted. At block 1308, the controller 1202 (not shown in FIG. 13) of the plush toy 100 may detect if the heart micro switch 1108 is turned on or not. As discussed above, the heart micro switch 1108 may be turned on by a user to activate interactive operations of the plush toy 100. If the controller 1202 determines that the heart micro switch 1108 is not turned on, the block 1308 evaluates as "N" (e.g., "No") and the routine 1300 stays at blocks 1306 and 1308.

On the other hand, if the heart micro switch 1108 is turned on, the block 1308 evaluates as "Y" (e.g., "Yes") and the routine 1300 proceeds to block 1310, where a user of the plush toy 100 may initiate interactive user experience.

At block 1310, the routine 1300 may proceed depending on configurations associated with the 3-position switch 1204 (not shown in FIG. 13). In some examples, if the 3-position switch 1204 is in a short mode, the routine 1300 may proceed directly to block 1314, where the plush toy 100 may play some "start-up" sound or music through the speaker 1222. For example, when the 3-position switch 1204 is in the short mode, a control signal may be transmitted from the 3-position switch 1204 to the controller 1202, which in response may generate a control signal to trigger the speaker 1222 play the "start-up" sound or music. Additionally, in some examples, the controller 1202 may trigger the LED 1224 to emit light according to certain pattern (e.g., flash, continuously glow, or the like) at block 1314.

In some examples, if the 3-position switch 1204 is switched by a user to be in a long mode, the routine 1300 may proceed to block 1312, where the LED 1224 of the plush toy 100 may exhibit other light emitting patterns. For example, the LED 1224 may emit slow pulse lighting (e.g., 1 pulse per second) or quick pulse lighting (e.g., 3 pulses per second). The routine 1300 may then proceed from block 1312 to block 1314, where the plush toy 100 may play the "start-up" music and the LED 1224 may emit different lighting patterns.

The routine 1300 may then proceed to block 1316, where the plush toy 100 may detect inputs from different input components (e.g., the paw tact switch 1206, the cap sensor 1208, the cap sensor 1210, the tilt switch 1212, the tilt switch 1214, the jiggle switch 1216, the microphone 1218, and the swipe switch 1220) and respond differently through the output components (e.g., the speaker 1222, the motor 314, the LED 1224), the eyes 206, the ears 940, the head 932, the neck 938 or other body parts of the plush toy 100.

In some examples, when the cap sensor 1208 is touched, the plush toy 100 may respond in a corresponding way. Specifically, when the cap sensor 1208 detects a touch by a user, the cap sensor 1208 may generate a sensor signal, which is sent to the controller 1202. In response, the controller 1202 may trigger the motor 314 to rotate in a certain number of turns to cause the rotating discs 212 rotate, which in turn causes the movement arms 208 move to positions such that the eyes 206 deform into the "HAPPY" expression as illustrated in FIGS. 7-8. Additionally, the controller 1202 may trigger the neck CAM A 934 and neck CAM B 936 (shown in FIG. 9A) to move such that the head 932 of the plush toy 100 may tilt toward one direction.

In some examples, when the cap sensor 1210 is touched, the plush toy 100 may respond in a different way compared with when the cap sensor 1208 is touched. For example, when the cap sensor 1210 detects a touch by a user, the cap sensor 1210 may generate a sensor signal, which is sent to the controller 1202. In response, the controller 1202 may trigger the motor 314 to rotate in a certain number of turns to cause the rotating discs 212 rotate, which in turn causes the movement arms 208 move to positions such that the eyes 206 deform into the "WINK" expression as illustrated in FIGS. 7-8. Additionally, the controller 1202 may trigger the CAM 942 (shown in FIG. 9B) to move such that the ears 940 of the plush toy 100 may move forward or backward. Additionally, the controller 1202 may trigger the speaker 1222 to play a giggle sound.

In some examples, when a user presses the paw tact switch 1206 while holding the hands of the plush toy 100, the plush toy may respond in a certain manner. For example, the plush toy 100 may show the "BLINK" expression in responses to the turning on of the paw tact switch 1206.

In some examples, when a user talks to the plush toy 100, the microphone 1218 may detect a sound and in response generates an input signal to the controller 1202. The controller 1202 may then cause the speaker 1222 to play a sound back to the user.

Figure 14:
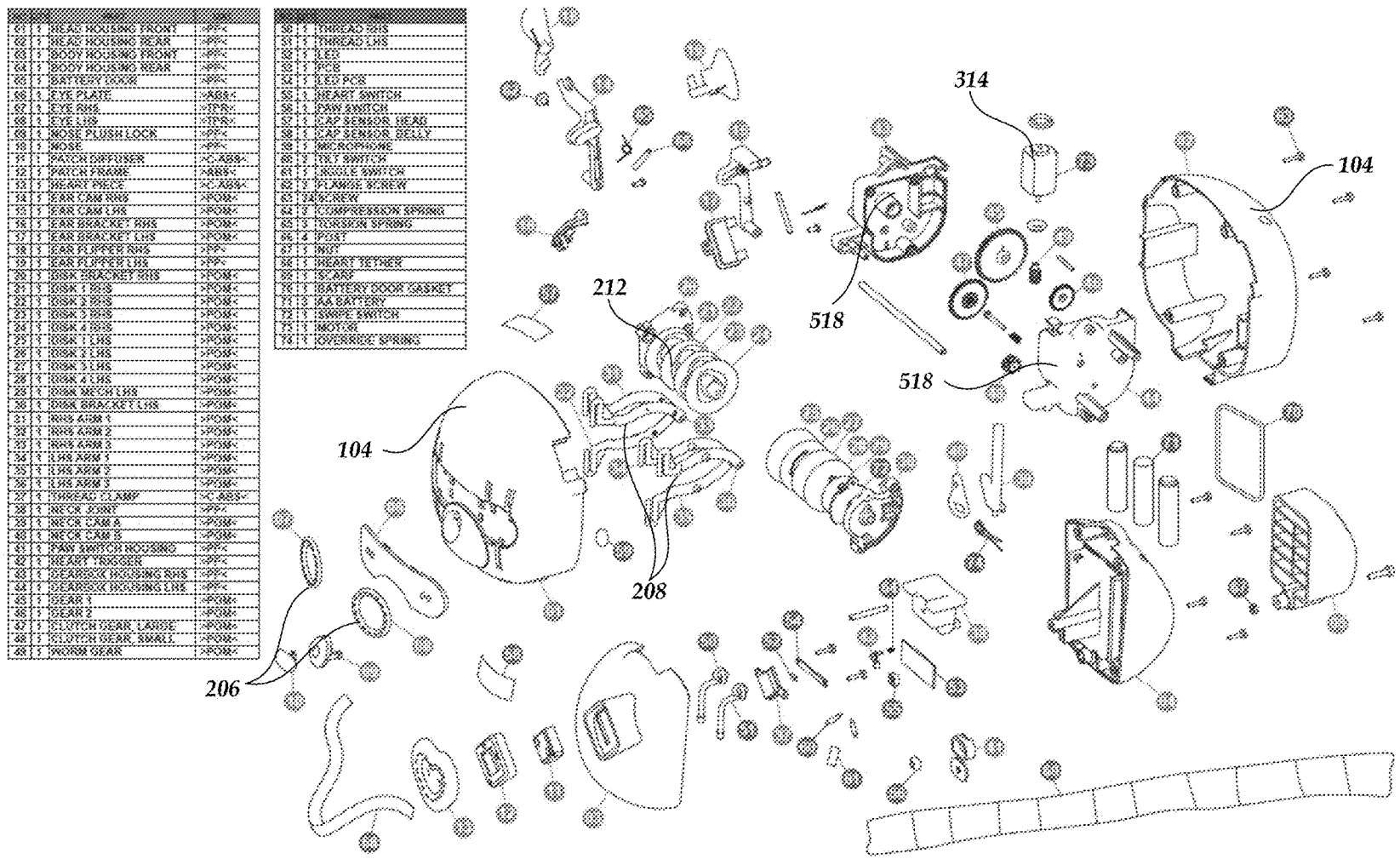
FIG. 14 illustrates an exploded view of some internal components of the example plush toy of FIGS. 1A-1C.

FIG. 14 illustrates an exploded view of some internal components of the plush toy 100 of FIGS. 1A-1C. For example, FIG. 14 shows exploded views of parts of the housing 104 of the plush toy 100. Additionally, FIG. 14 shows an illustration of the rotating discs 212 along with the movement arms 208, where the rotating discs 212 and movement arms 208 can facilitate the movements of the eyes 206. Further, FIG. 14 shows the motors 314 and the exploded views of the gearbox 518 along with gears inside the gearbox 518. As discussed above, in some embodiments, the motion of the motor 314 may turn the one or more gears inside the gearbox 518, which in turn may cause the rotating discs 212 to rotate. The rotation of the rotating discs 212 may cause the movement arms 208 to change positions, thereby producing different movements of the eyes 206. In some examples, the movements of the eyes 206 may be paired with the movements of other body parts (e.g., head tilting or ear moving forward or backward) of the plush toy 100.

Figure 15:
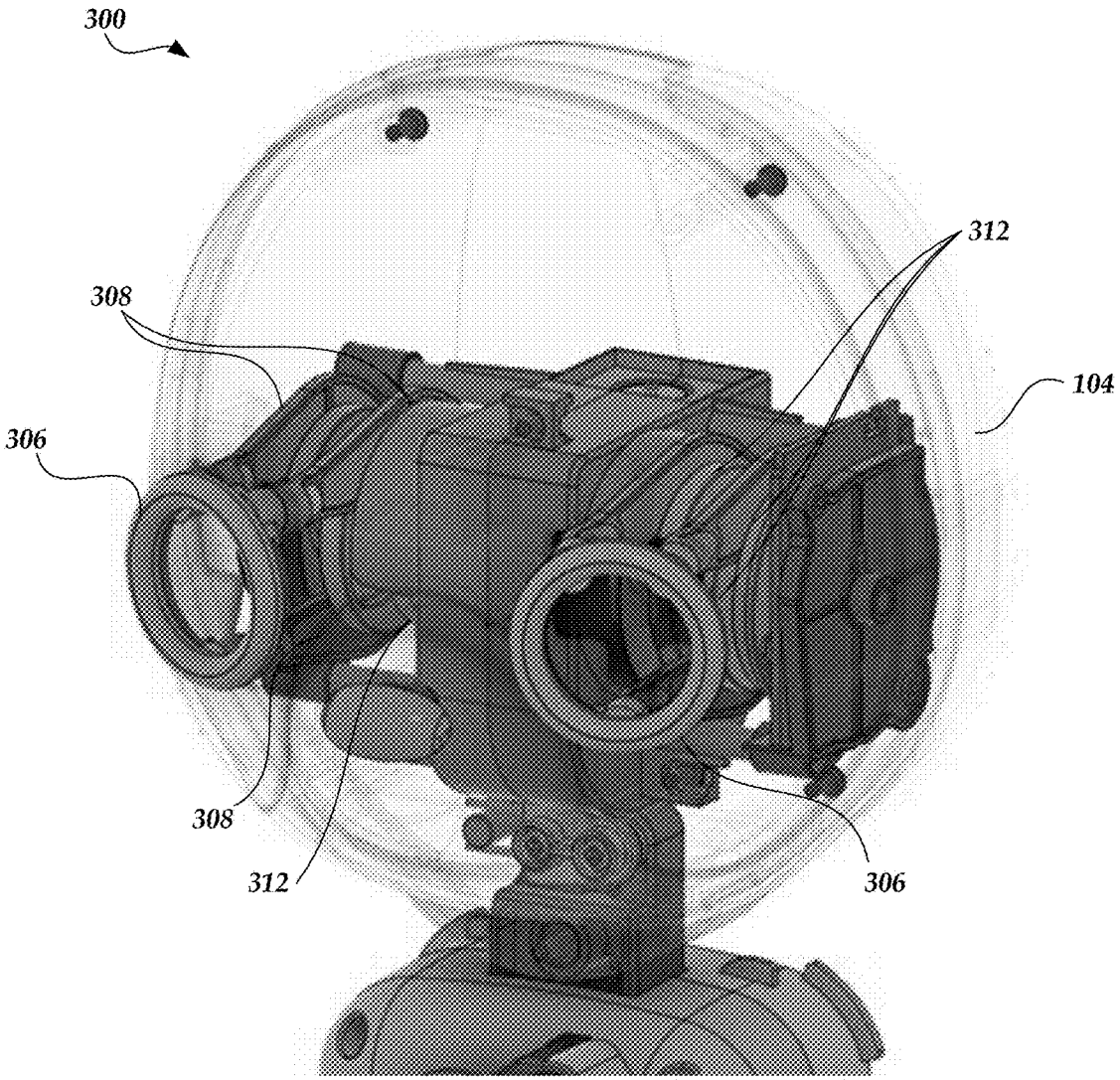
FIG. 15 is a front perspective view of an internal structure of another example plush toy that does not include ear articulation.

FIG. 15 is a front perspective view of an internal structure 300 of another example plush toy 100 that does not include ear articulation. The structures and features of the embodiments disclosed herein can be combined in numerous ways without deviating from the scope of this disclosure. The operation of components of the internal structure 300 is similar to the operation of the components of the internal structure 200 described above.

Figure 16:
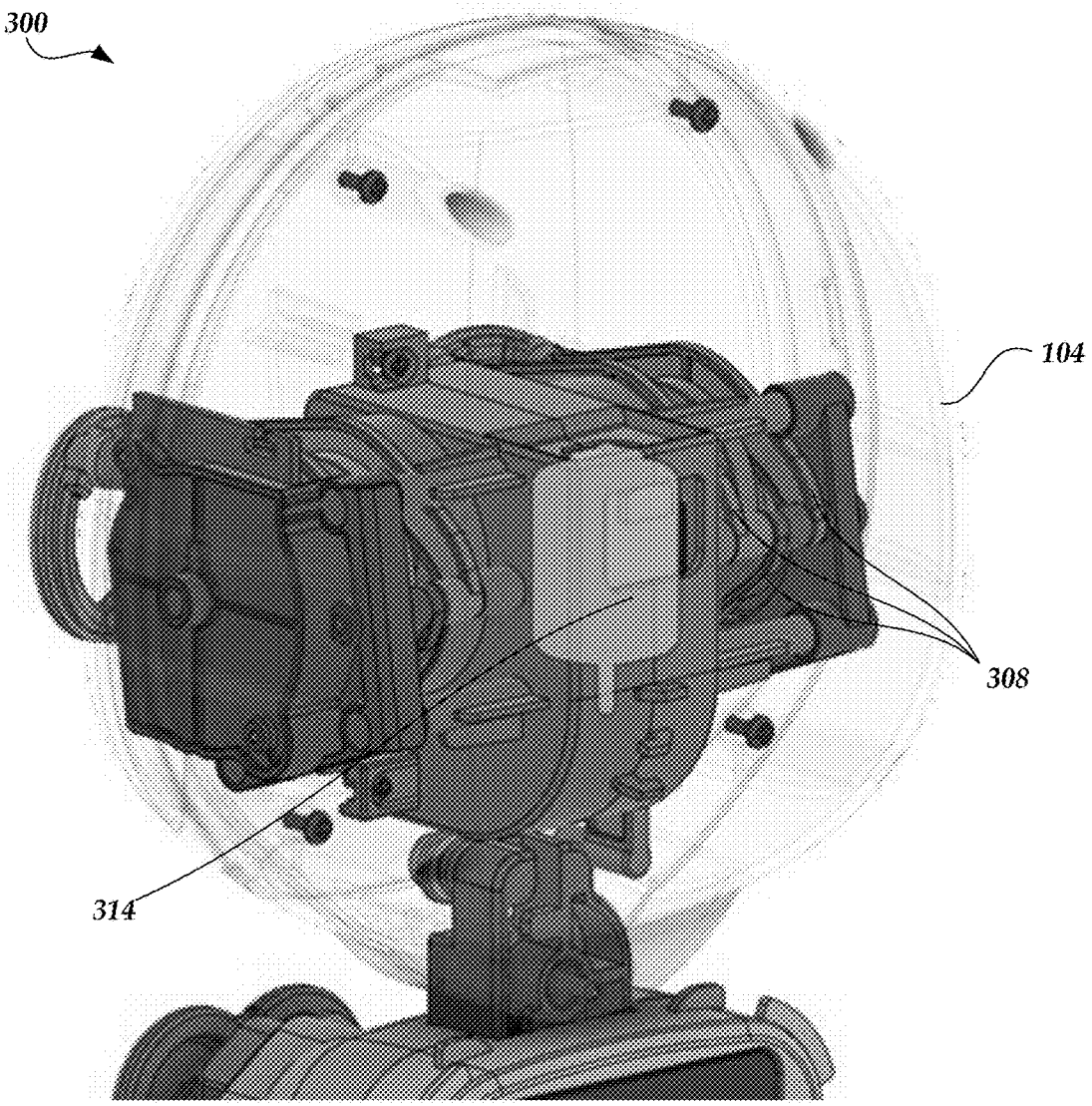
FIG. 16 is a back perspective view of the internal structure of FIG. 15.

The FIG. 16 is a back perspective view of the internal structure 300 of FIG. 15. The internal structure 300 includes the housing 104, movement arms 308, eyes 306, and rotating discs 312. The movement arms 308 and eyes 306 are deployed on the surface of the housing 104 while the rotating discs 312 are accommodated within the housing 104. In some embodiments, the eyes 306 are made of thermoplastic rubber (TPR). However, it should be noted that other materials that are deformable can be utilized to make the eyes 306.

As illustrated in FIG. 16, a motor 314 is housed within the housing 104. In operation, the motor 314 may drive movements of the eyes 306 of the plush toy 100 to switch between different facial expressions. Specifically, the motor 314 may power rotational movements (e.g., rotating forward or backward) of the rotating discs 312, which in turn will cause the movement arms 308 to move up or move down, thereby deforming the eyes 306 into different shapes to accomplish different facial expressions through eye movements.

Figure 17:
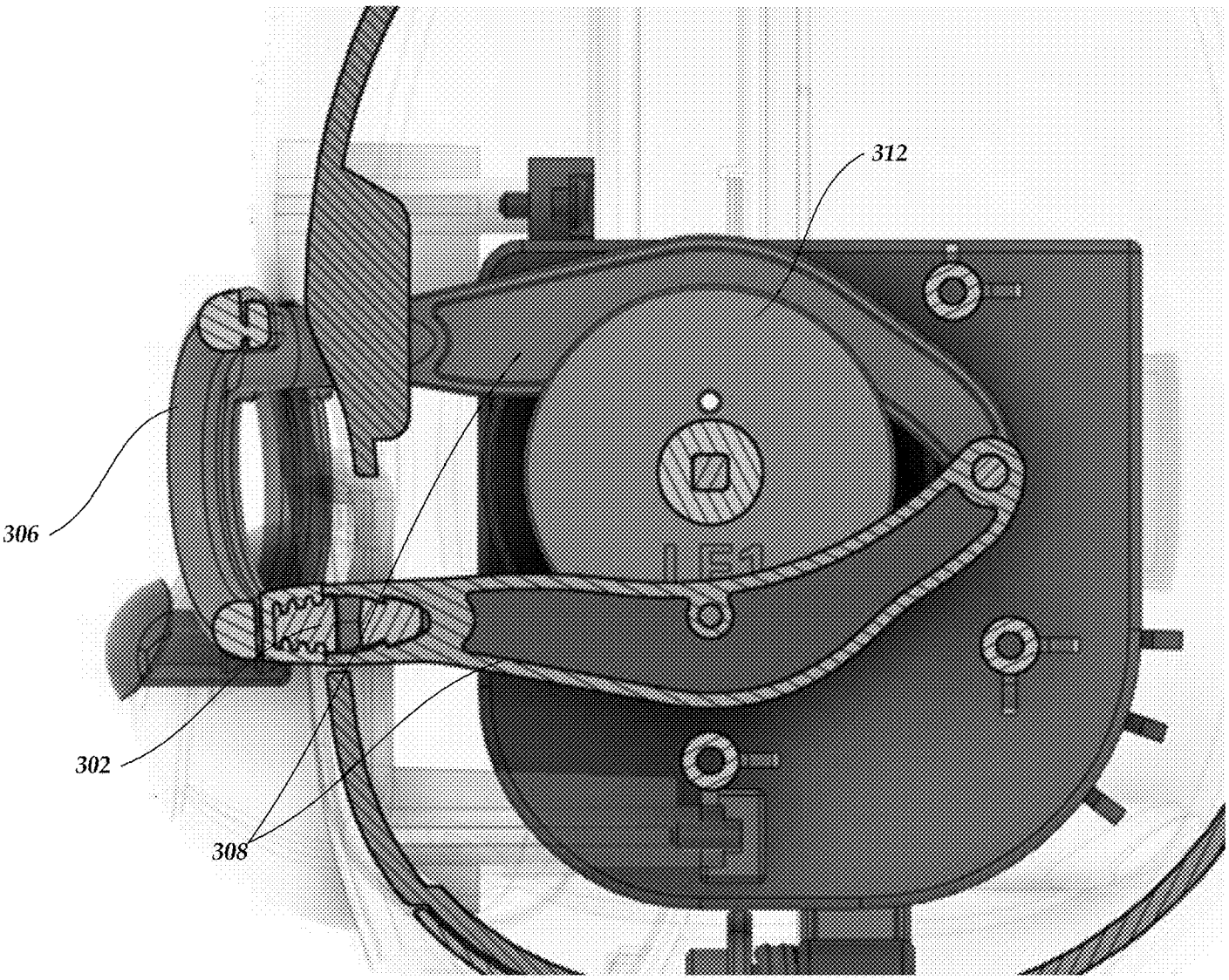
FIG. 17 is a cross-section view through the middle movement arm of the left eye.

FIG. 17 is a cross-section view through the middle movement arm 308 of the left eye 306. As shown most clearly in FIG. 17, for each of the eyes 306, there are three attachment points 302 associated with the movement arms 308. As the movement arms 308 move up or down, the eyes 306 may be deformed (because of the moving up or down of the three attachment points 302) into different shapes to provide different facial expressions of the plush toy 100 through eye movements or varying eye shapes. Although three attachment points 302 are associated with each of the eyes 306, it should be noted that other number of attachment points 302 may be associated with each of the eyes 306.

Figure 18:
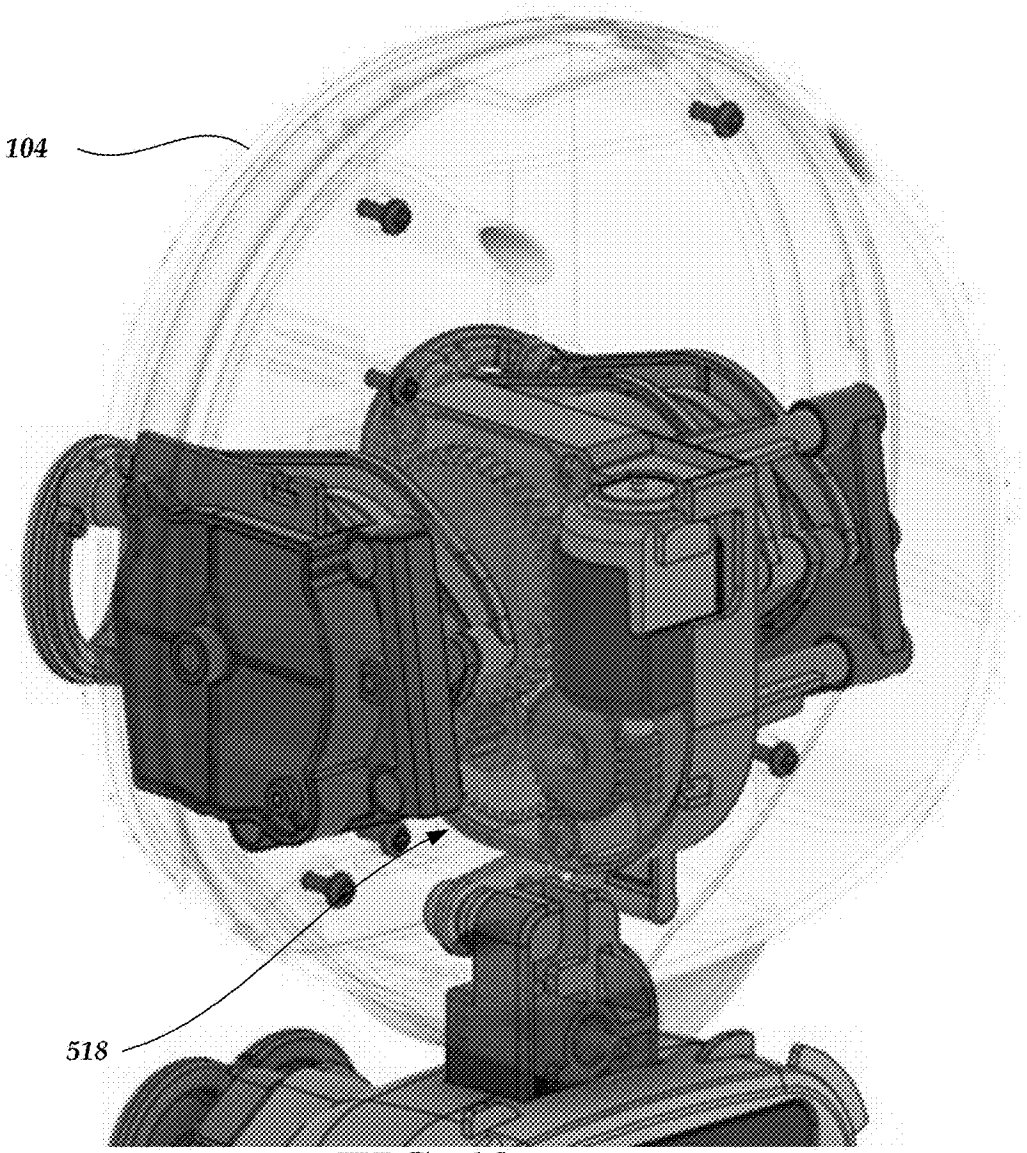
FIG. 18 is another back perspective view of the internal structure of FIG. 15 showing the gearbox.

FIG. 18 is another back perspective view of the internal structure of FIG. 15 showing the gearbox 518. In some embodiments, the motor 314 and the gearbox 518 are disposed within the housing 104, which provides protection to the motor 314 and the gearbox 518. As is illustrated in FIG. 18, the motor 314 may be connected to the gearbox 518. In some embodiments, the gearbox 518 may provide one or more gears. In some embodiments, some inputs from a user may trigger the motor 314 to run, which in turn will cause the one or more gears of the gearbox 518 to turn clockwise or counter-clockwise. The movement of the one or more gears of the gearbox 518 may then cause one or more rotating discs 312 to rotate.

Figure 19:
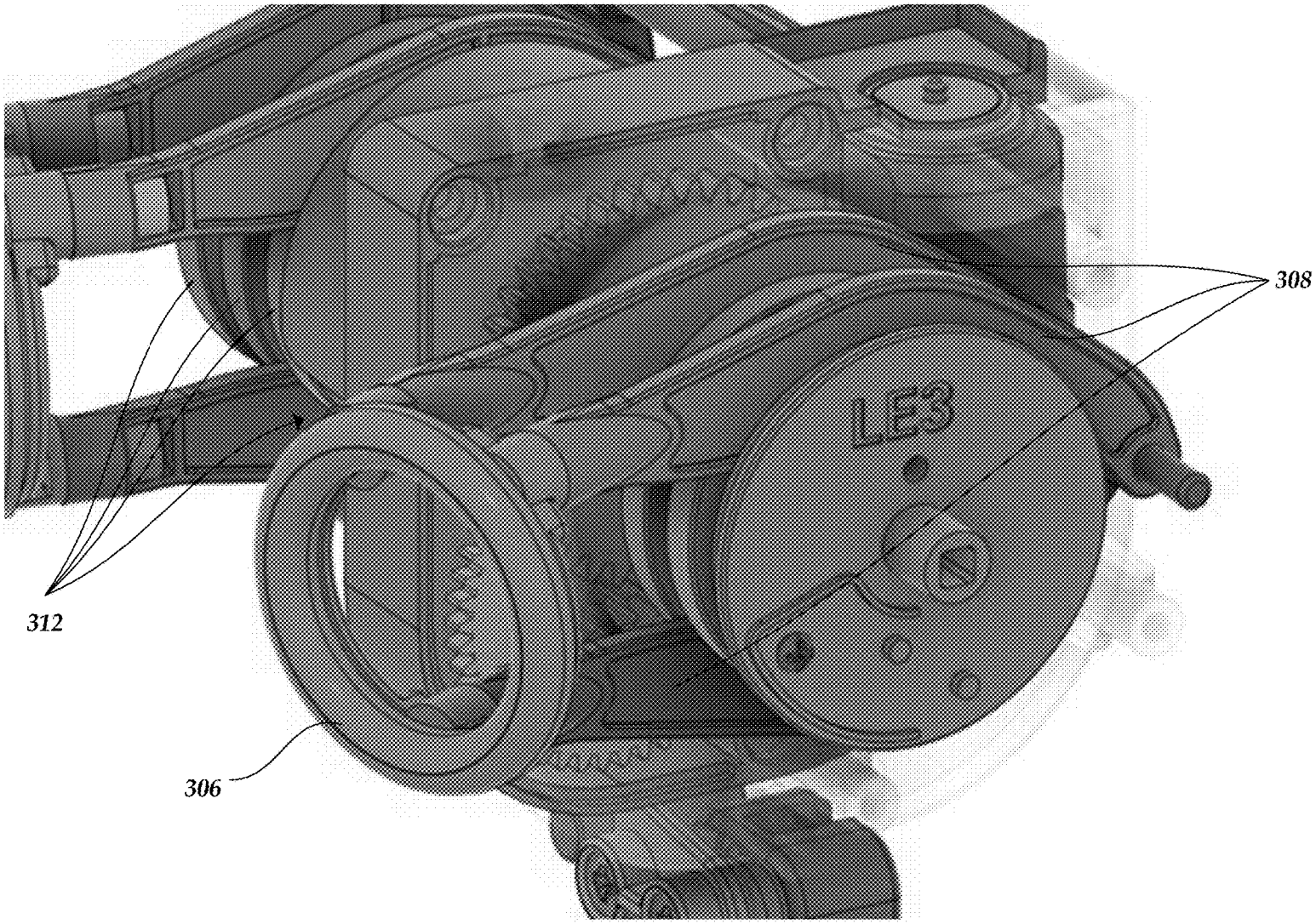
FIG. 19 is a partially exploded view with a left disk bracket removed to show one or more rotating discs and one or more movement arms.

FIG. 19 is a partially exploded view with a left disk bracket removed to show one or more rotating discs 312 and one or more movement arms 308. The movement of the rotating discs 312 can be caused by the operation of the motor 314 and gearbox 518. In some examples, the motor 314 may be programmed to run specified turns so as to create different combinations of positions for the rotating discs 312 and the movement arms 308, thereby causing different facial expressions due to different eye movements.

Figure 20:
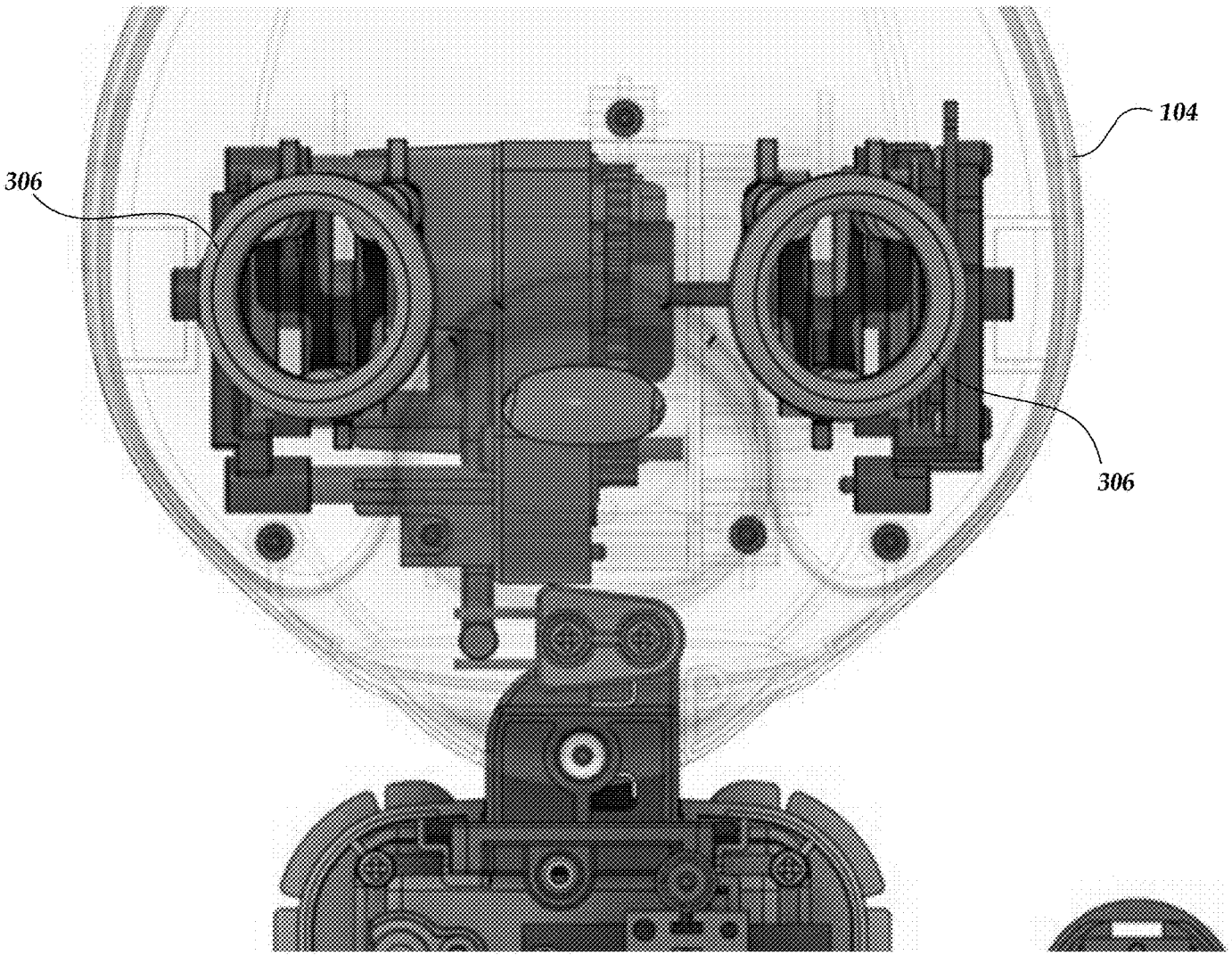
FIG. 20 is a front view of the internal structure of FIG. 15.
Figure 21:
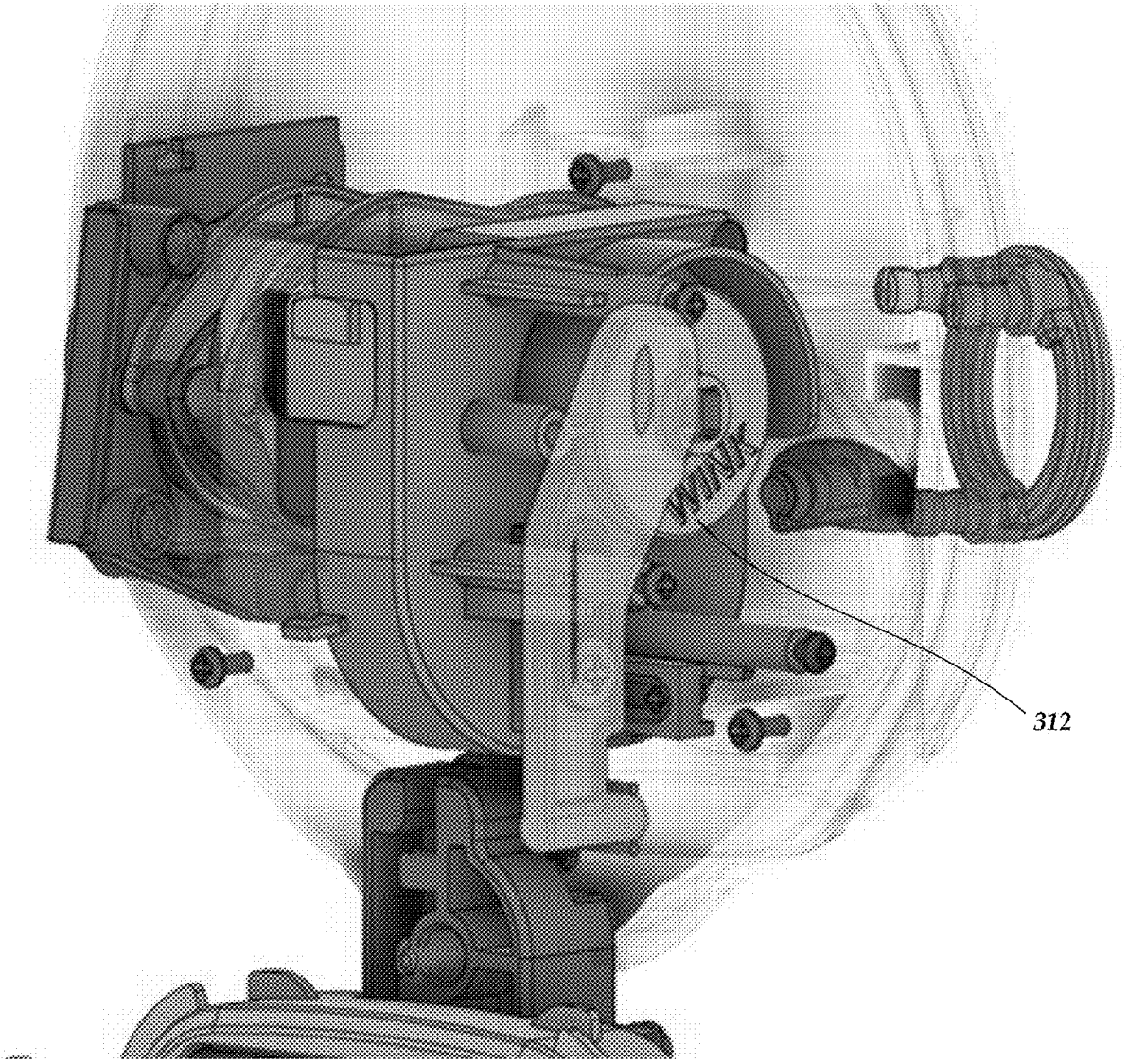
FIG. 21 is a partially exploded view with the right disk bracket, the one or more movement arms, and some of the rotating discs removed to show one of the rotating discs.

FIG. 20 is a front view of the internal structure 300 of FIG. 15. FIG. 21 is a partially exploded view with the right disk bracket, the one or more movement arms 308, and some of the rotating discs 312 removed to show one of the rotating discs 312.

Figures 22A, 22B, 22C:
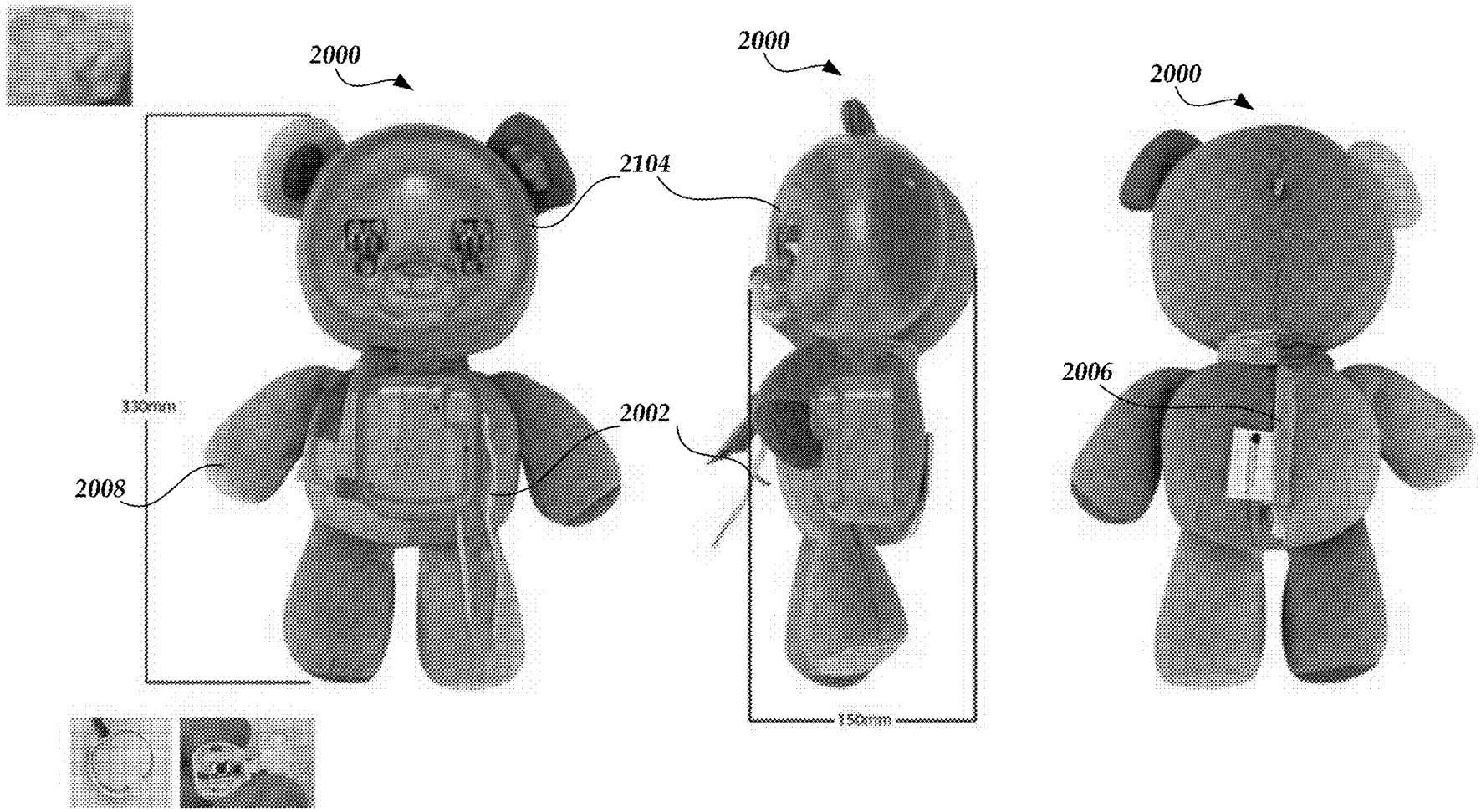
FIGS. 22A-22C illustrate various views of another example plush toy according to some embodiments of the present disclosure.

FIGS. 22A-22C illustrate various views of another example plush toy 2000 according to some embodiments of the present disclosure. The embodiment illustrated in FIGS. 22A-22C includes eyes 2206 that are filled in contrast to the hollow eyes illustrated in FIGS. 1A-1C. The structures and features of the different embodiments disclosed herein can be combined in numerous ways without deviating from the scope of this disclosure. Thus, components and features disclosed herein can be combined in different ways while still falling within the scope of this disclosure. For example, the operation of components of the internal structure 2200 can be similar to the operation of the components of the internal structures 200, 300 described above.

In certain embodiments, for example as is illustrated in FIGS. 22A-22C, the entire eye (including the center) 2206 is molded, over the fabric substrate 2416. In contrast, each eye illustrated in FIGS. 1A-1C are formed as a hollow outer ring. In certain embodiments, the eyes 2206 illustrated in FIGS. 22A-22C are co-molded directly onto the fabric substrate 2416. In certain embodiments, the eyes 2206 are then attach to the movement arms 2208 that are attached to the motor on the inside of the toy 2000.

In some embodiments, the eyes 2206 are made of thermoplastic rubber (TPR). However, it should be noted that other materials that are deformable can be utilized to make the eyes 2206.

The embodiment of the plush toy 2000 illustrated in FIGS. 22A-22C does not include mechanically-linked ear movements as described with respect to the embodiment illustrated in FIGS. 1A-1C. The embodiment of the plush toy 2000 illustrated in FIGS. 22A-22C is not illustrated as including a clear lens component at its heart. Instead, for the embodiment illustrated in FIGS. 22A-22C, a light 2610 (e.g., LED) mounted behind the fabric substrate 2416 so the light 2610 can shine through and or illuminate the fabric substrate 2416 when on. The heart of the embodiment of the plush toy 2000 illustrated in FIGS. 22A-22C is no longer tethered to the plush bear toy unlike the embodiment illustrated in FIGS. 1A-1C. However, as explained above, the components and features disclosed herein can be combined in different ways while still falling within the scope of this disclosure.

As illustrated in FIGS. 22A-22C, the plush toy 2000 can take the form of a miniature bear at a miniaturized size. However, it should be noted that the plush toy 2000 is not limited to the illustrated shape or size and can have any other shapes or sizes. In some embodiments, weighted pellets may be stuffed in arms and legs of the plush toy 2000.

Further, a switch 2008 may be embedded (e.g., not exposed to view) under one or both arms of the plush toy 2000 for facilitating interactive operations with a user, which will be described in greater detail below. Additionally, in some embodiments, polyester fiber may be stuffed in the head, body, arms and legs of the plush toy 2000. However, it should be noted that other materials may be used to stuff the interior of the plush toy 2000.

As shown in FIG. 22A, a pair of threads 2002 are hanging in front of the chest of the plush toy 2000. FIG. 22A also shows a housing 2104 (hidden from view of a user) of the plush toy 2000. In some embodiments, the housing 2104 accommodates mechanical or electrical components (not shown in FIG. 22A) that facilitate interactive operations (e.g., different facial expressions) of the plush toy 2000 as will be discussed in greater detail below. In certain embodiments, the housing 2104 comprises plastic. Of course the housing 2104 can comprise other materials or more than one material and still fall within the scope of this disclosure.

As shown in FIG. 22B, an embodiment of the plush toy 2000 can have a thickness of 150 mm from the nose on the front side to the back of the head. However, it should be noted that the plush toy 2000 may have any other suitable thickness. In some embodiments, the housing 2104 has a compact size and shape to accommodate the mechanical or electrical components (not shown in FIG. 22B) needed for facilitating interactive operations. As such, the size, cost and weight of the plush toy 2000 may be reduced.

FIG. 22C illustrates a back view of the plush toy 2000. As shown in FIG. 22C, the plush toy 2000 may have a velcro strip 2006 on its back to allow a user to access one or more batteries that are utilized to power the plush toy 2000. In some embodiments, the velcro strip 2006 can allow a tether (not shown in FIG. 22C) to go through for tying the plush toy 2000 to a package.

Figure 23:
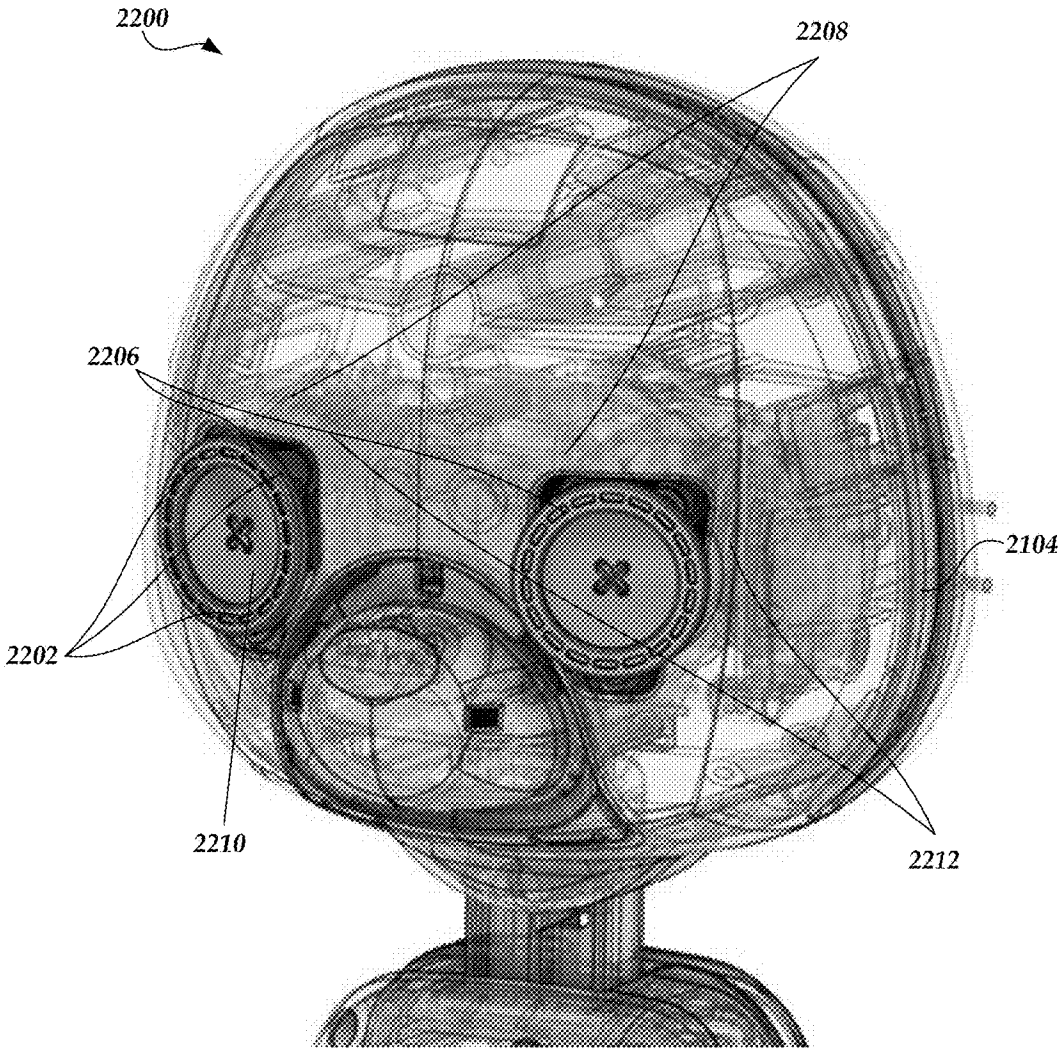
FIG. 23 is a front perspective view of an internal structure of the example plush toy illustrated in FIGS. 22A-22C.

FIG. 23 is a front perspective view of an internal structure 2200 of the example plush toy 2000 illustrated in FIGS. 22A-22C. Referring to FIG. 23, the internal structure 2200 includes the housing 2104, movement arms 2208, eyes 2206, and rotating discs 2212. As illustrated in FIG. 23, the eyes 2206 are disposed over the surface of the housing 2104. In certain embodiments, the eyes 2206 are molded over the fabric substrate 2416 which covers the housing 2104. In certain embodiments, the eyes 2206 are co-molded directly onto the fabric substrate 2416. In certain embodiments, the eyes 2206 are then attach to the movement arms 2208. For example, in certain embodiments, the eyes 2206 attach to distal ends of the movement arms 2208.

Figure 26:
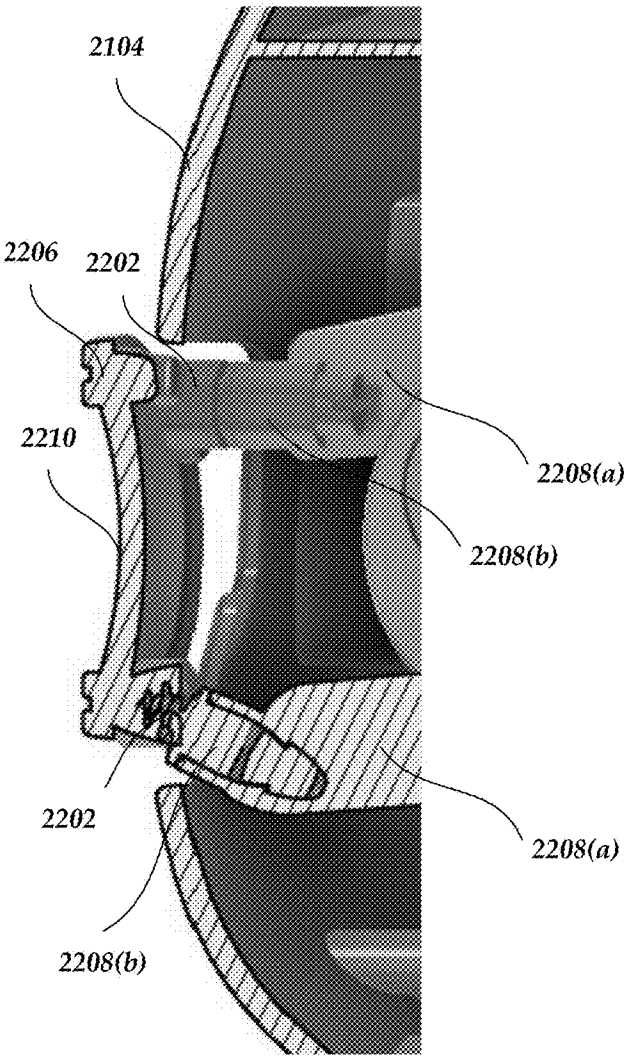
FIG. 26 illustrates a cross-section schematic of parts of the internal structure of FIG. 23.

In the illustrated embodiment, the movement arm 2208 comprise a base portion 2208(*a*) and a distal portion 2208(*b*) (see FIG. 26). In certain embodiments, the movement arms 2208 extend from inside the housing 2104 and through the surface of the housing 2104 so that the distal portion 2208(*b*) of the movement arm 2208 is accessible to couple with the eye 2206. The rotating discs 2212 are accommodated within the housing 2104 and couple to the movement arms 2208. In this way, rotation of the discs 2212 moves the movement arms 2208. For example, in certain embodiments, rotation of the discs 2212 moves the movement arms 2208 in up and down directions. Of course the movement direction of the movement arms 2208 is not limited to up and down. For example, in certain embodiments, the movement arms 2208 are configured to move in left and right directions.

As shown in FIG. 23, for each of the eyes 2206, there are three attachment points 2202 associated with the movement arms 2208. Although three attachment points 2202 are associated with each of the eyes 2206, it should be noted that other number of attachment points 2202 may be associated with each of the eyes 2206. For example, in certain embodiments, each eye 2206 comprises two attachment points 2202. In other embodiments, each eye 2206 comprises four or more attachment points 2202. Thus, the disclosure is not limited to the illustrated number of attachment points 2202.

In operations that will be illustrated below, as the movement arms 2208 move up or down, the eyes 2206 may be deformed (because of the moving up or down of the attachment points 2202) into different shapes to provide different facial expressions of the plush toy 2000 through eye movements or varying eye shapes.

Figure 24:
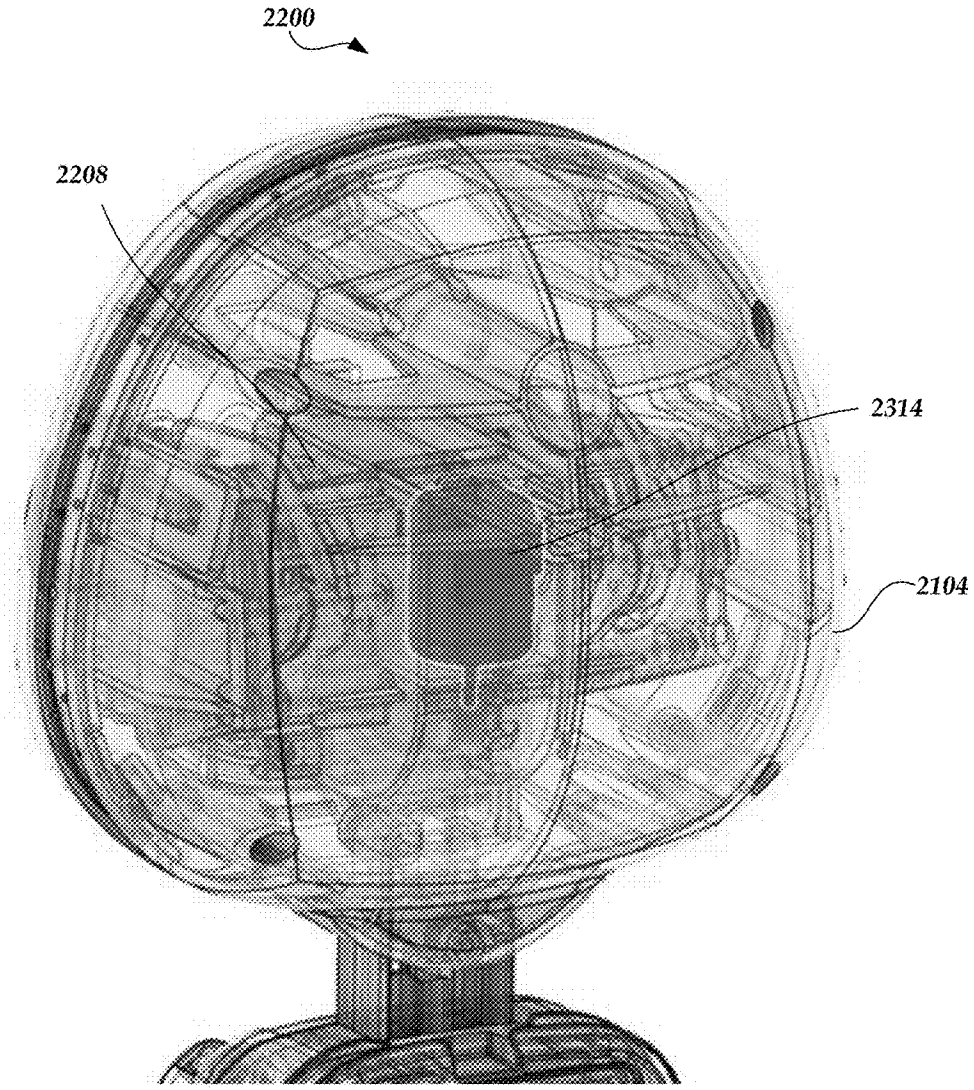
FIG. 24 is a back perspective view of the internal structure of FIG. 23.

FIG. 24 shows a back perspective view of the internal structure 2200. As illustrated in FIG. 24, a motor 2314 is housed within the housing 2104. In operation, the motor 2314 may drive movements of the eyes 2206 of the plush toy 2000 to switch between different facial expressions as is described with respect to motor 314. Specifically, the motor 2314 may power rotational movements (e.g., rotating forward or backward) of the rotating discs 2212, which in turn will cause the movement arms 2208 to move up or move down, thereby deforming the eyes 2206 into different shapes to accomplish different facial expressions through eye movements. While the illustrated embodiments show the eyes 2206 of the face as being the deforming part that changes shape, the disclosure is not so limited. In other embodiments, the nose, mouth, ear, eyebrow, and/or other facial features can be the deforming part alone or in combination with another deforming part (e.g., eyes).

Figure 25:
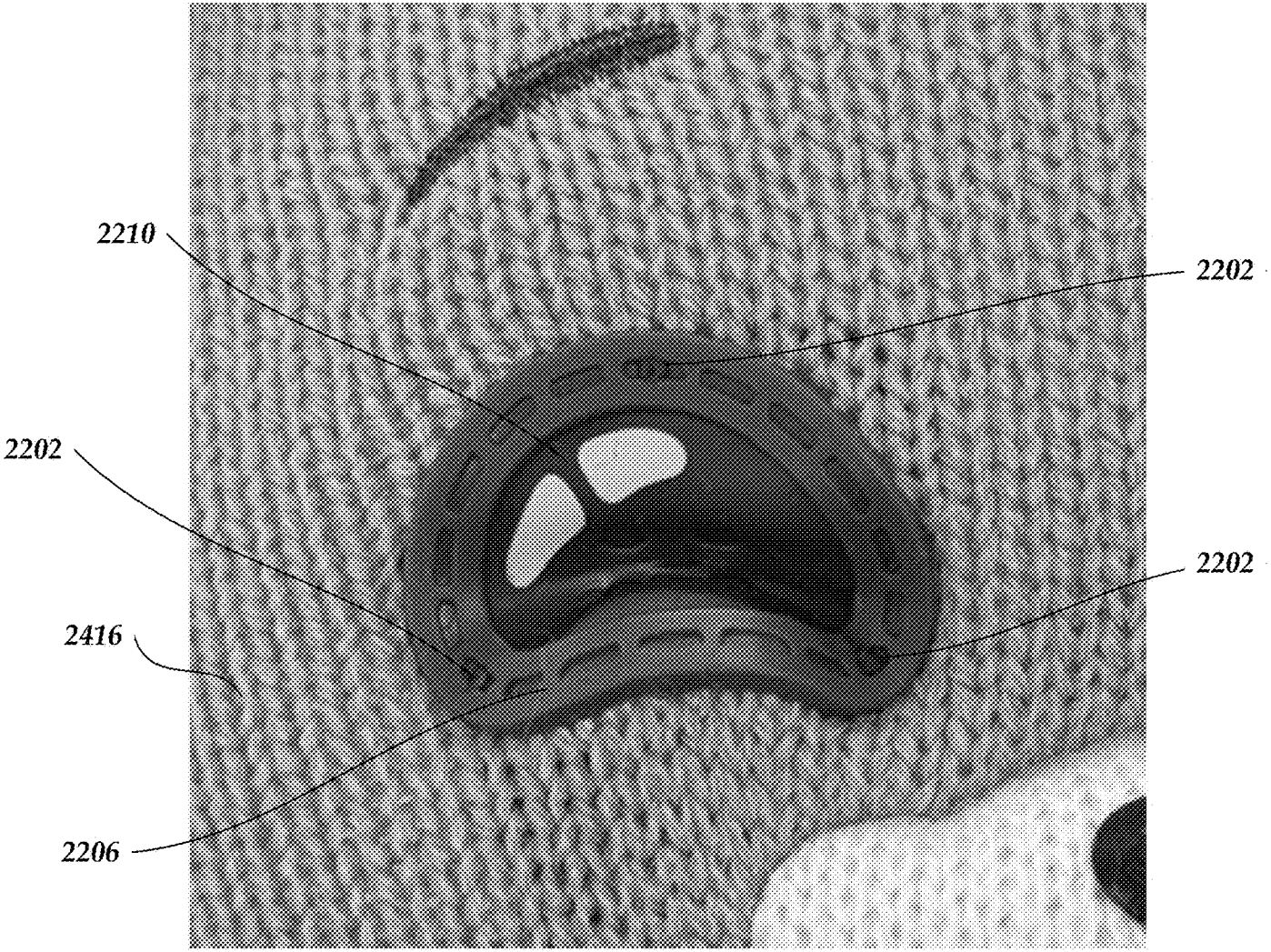
FIG. 25 illustrates components around an eye of the example plush toy illustrated in FIGS. 22A-22C.

FIG. 25 illustrates a perspective view of parts of the plush toy 2000 of FIGS. 22A-22C around the eyes 2206. Specifically, FIG. 25 shows the eye 2206 including a center portion 2210 of the eye 2206 in a deformed state. In certain embodiments, the entire eye 2206 (including the center portion 2210) is molded over the fabric substrate 2416. In certain embodiments, the eyes 2206 are co-molded directly onto the fabric substrate 2416. In certain embodiments, the eyes 2206 are then attach to the movement arms 2208 that are attached to the motor 2314 on the inside of the toy 2000. In some embodiments, the eyes 2206 are made of thermoplastic rubber (TPR). However, it should be noted that other materials that are deformable can be utilized to make the eyes 2206.

FIG. 25 further illustrates the eyes 2206 comprise the attachment points 2202 for engaging with the movement arms 2208. As is illustrated, the distal portions 2208(*b*) of the movement arms 2208 protrude into the fabric substrate 2416 to engage with the eye 2206 at the attachment points 2202.

FIG. 26 illustrates a cross-section schematic of parts of the internal structure 2200 of FIG. 23 with the fabric substrate 2416 removed. In certain embodiments, the distal portion 2208(*b*) of the movement arm 2208 is attached to the attachment point 2202 of the eye 2206. In certain embodiments, a base portion 2208(*a*) of the movement arm 2208 is coupled to the rotating discs 2212. Of course, in certain other embodiments, the movement arm 2208 can comprise a unitary structure or more than two components and still fall within the scope of this disclosure.

Figure 27:
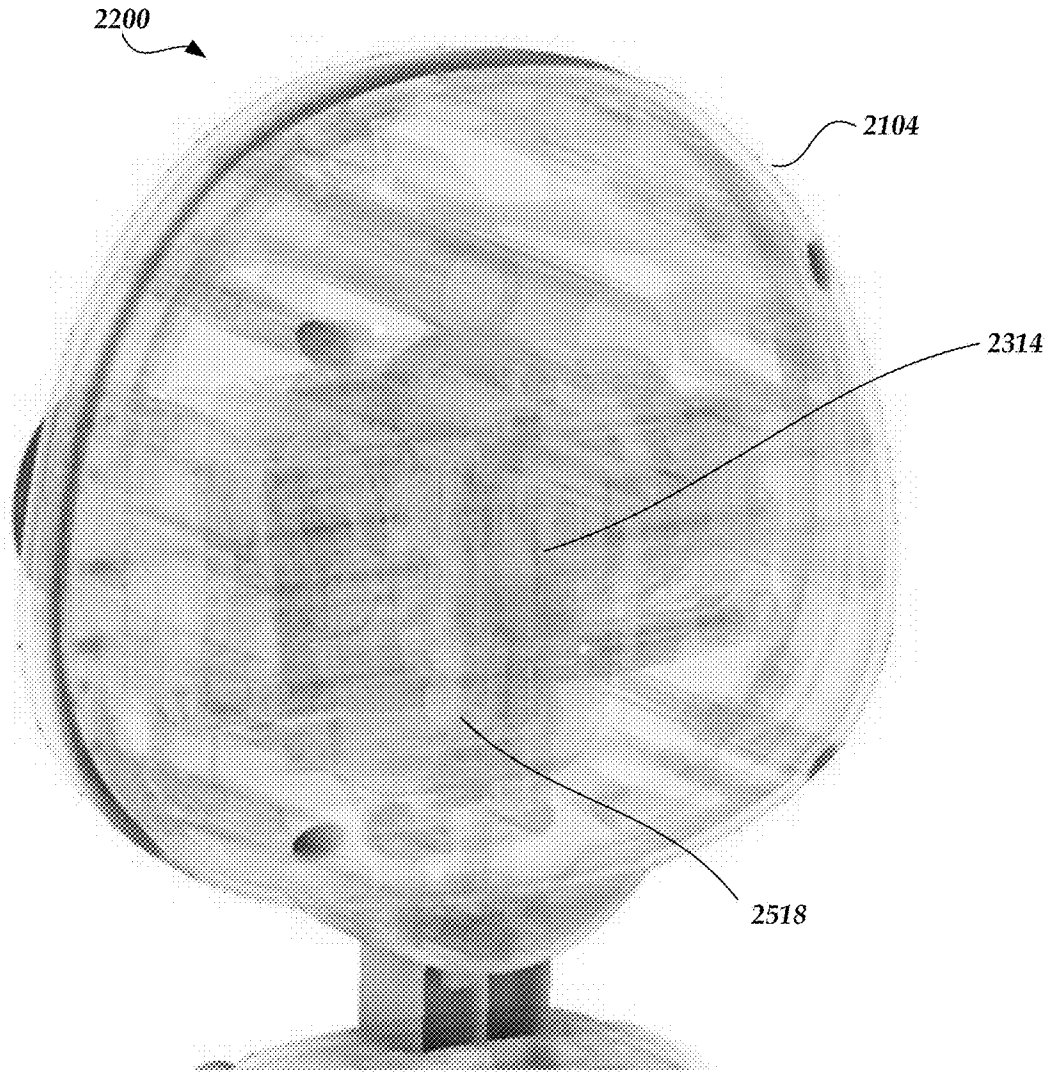
FIG. 27 is another back perspective view of the internal structure of FIG. 23.

FIG. 27 shows another back perspective view of the internal structure 2200 of FIG. 23. As shown in FIG. 27, the internal structure 2200 includes the housing 2104, the motor 2314 and the gearbox 2518. In some embodiments, the motor 2314 and the gearbox 2518 are disposed within the housing 2104, which provides protection to the motor 2314 and the gearbox 2518. Although not readily observed from FIG. 27, the motor 2314 may be connected to the gearbox 2518.

In some embodiments, the gearbox 2518 may provide one or more gears. In some embodiments, some inputs from a user may trigger the motor 2314 to run, which in turn will cause the one or more gears of the gearbox 2518 to turn clockwise or counter-clockwise. The movement of the one or more gears of the gearbox 2518 may then cause one or more rotating discs 2212 to rotate.

Figure 28:
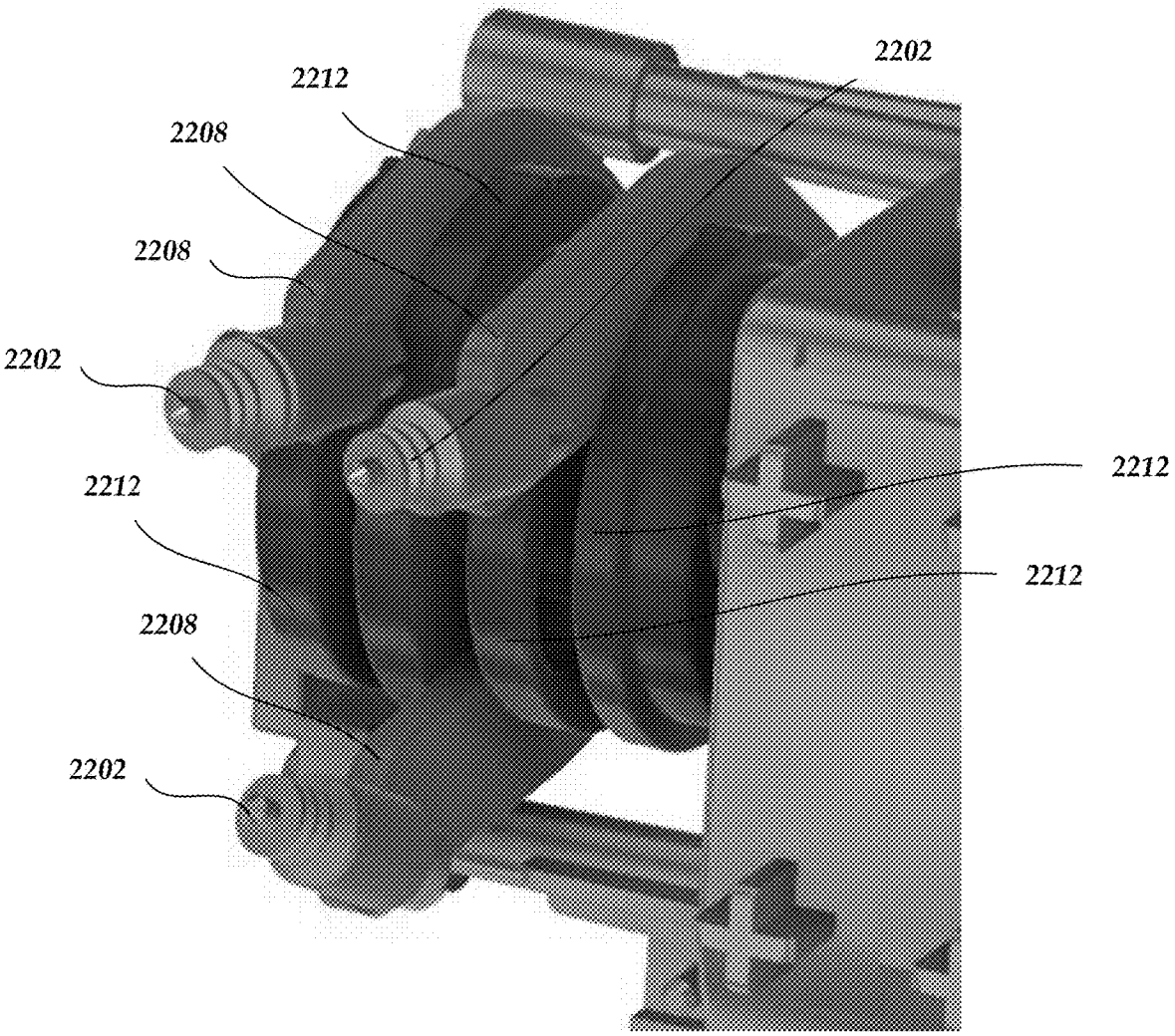
FIG. 28 is an expanded view showing portions of the internal structure of FIG. 23 in operation.

FIG. 28 is an expanded view showing portions of the internal structure 2200 of FIG. 23 in operation. Specifically, FIG. 28 illustrates the movement of the rotating discs 2212, which can be caused by the operation of the motor 2314 and gearbox 2518 of FIG. 27. In some embodiments, the motor 2314 may be programmed to run specified turns so as to create different combinations of positions for the rotating discs 2212 and the movement arms 2208, thereby causing different facial expressions due to different eye movements. For example, certain operation from a user may cause the motor 2314 to run in a way such that the movement arms 2208 are configured to the positions illustrated in FIGS. 7, 8, and 29, deforming the eyes through movements into a shape resembling an expression of "blink" of eyes.

Figure 29:
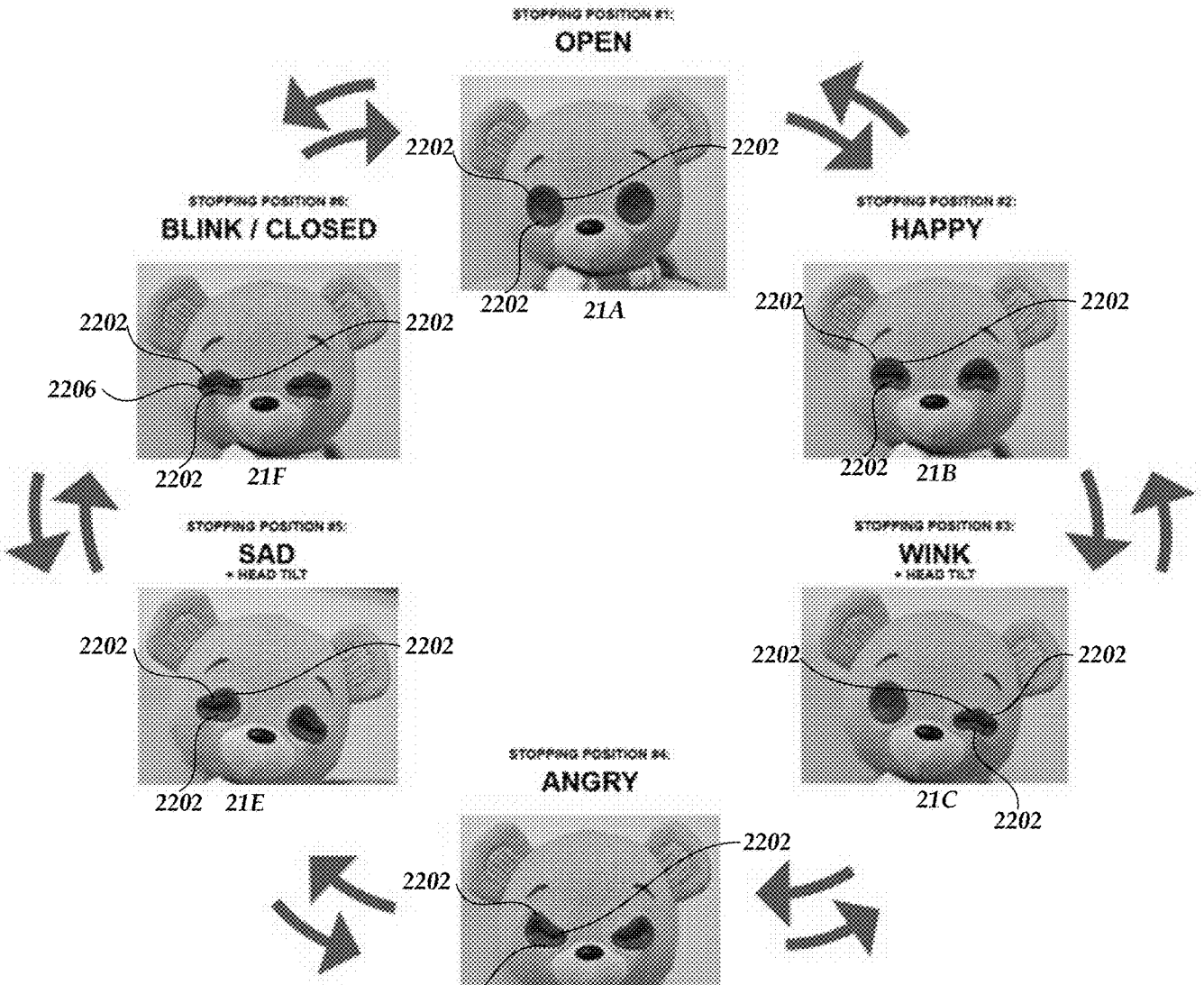
FIG. 29 illustrates an example expression transition cycle of the example plush toy illustrated in FIGS. 22A-22C.

Moving to FIG. 29, embodiments of different facial expressions provided by the plush toy 2000 of FIGS. 22A-22C based on different positions of three movement arms 2208 (e.g., connection points 2202) associated with eyes 2206 (e.g., a left eye 2206 and a right eye 2206) are depicted. FIG. 29 further shows an example expression transition cycle of the example plush toy 2000 illustrated in FIGS. 22A-22C.

Shown on the top is the facial expression ("OPEN") in which the eyes 2206 are fully open. The "OPEN" expression can be achieved by configuring the movement arms 2208 to the configuration 21A. In some examples, the configuration 21A can be obtained when the plush toy 2000 receives specific input (e.g., touch certain sensors on certain parts of the plush toy 2000 and turn on certain switches of the plush toy 2000) that causes the motor 2314 to run a specified number of turns.

Shown on the top right is the facial expression ("HAPPY") in which both eyes 2206 are not fully open or both open to a degree slightly less than the "OPEN" expression. The "HAPPY" expression can be achieved by configuring the movement arms 2208 (e.g., connection points 2202) to the configuration 21B. In some examples, the configuration 21B can be obtained when the plush toy 2000 receives specific input that causes the motor 2314 to run a specified number of turns, similar to how the configuration 21B is obtained.

Shown on the bottom right is the facial expression ("WINK") in which one of the eyes 2206 is little open and the other of the eyes 2206 is fully open. The "WINK" expression can be achieved by configuring the movement arms 2208 (e.g., connection points 2202) to the configuration 21C. In some examples, the configuration 21C can be obtained when the plush toy 2000 receives specific input that causes the motor 2314 to run a specified number of turns, similar to how the configuration 21A or 21B is obtained.

Shown on the bottom is the facial expression ("ANGRY") in which the eyes 2206 are closed a little bit downward. The "ANGRY" expression can be achieved by configuring the movement arms 2208 (e.g., connection points 2202) to the configuration 21D. In some examples, the configuration 21D can be obtained when the plush toy 2000 receives specific input (e.g., touch certain sensors on certain parts of the plush toy 2000 and turn on certain switches of the plush toy 2000) that causes the motor 2314 to run a specified number of turns, similar to how the configurations 21A-21C are obtained.

Shown on the bottom left is the facial expression ("SAD") in which both eyes 2206 are not fully open or both open to a degree slightly less than the "OPEN" expression. The "SAD" expression can be achieved by configuring the movement arms 2208 (e.g., connection points 2202) to the configuration 21E. In some examples, the configuration 21E can be obtained when the plush toy 2000 receives specific input that causes the motor 2314 to run a specified number of turns, similar to how the configurations 21A-21D are obtained.

Shown on the top left is the facial expression ("BLINK") in which one of the eyes 2206 is a little open and the other of the eyes 2206 is fully open. The "BLINK" expression can be achieved by configuring the movement arms 2208 (e.g., connection points 2202) to the configuration 21F. In some examples, the configuration 21F can be obtained when the plush toy 2000 receives specific input that causes the motor 2314 to run a specified number of turns, similar to how the configurations 21A-21E are obtained.

Different expressions of the example plush toy 2000 may correspond to different eye movements, eye shapes or deformations of the eyes 2206. In certain embodiments, deformations of the eyes 2206 can be driven by the motor 2314. The rotation of the motor 2314 may be controlled by a controller (not shown in FIG. 29) according to a program executable by the controller. Specifically, the controller may control how many turns the motor 2314 is to run or rotate based on different user interactions. The number of turns the motor 2314 rotates may then affect how the rotating discs 2212 rotate (e.g., the number of degrees the rotating discs 2212 rotates), which may affect the positions of the movement arms 2208 and the attachment points 2202, thereby causing the eyes 2206 to be deformed into various shapes as illustrated in FIGS. 7, 8, and 29.

As shown in FIG. 29, the example plush toy 2000 may start with a default expression "OPEN" where the eyes 2206 open in a shape similar to or the same as circles. In some embodiments, when the motor 2314 is programmed to rotate clockwise, the next expression that the plush toy 2000 may manifest is the "HAPPY" expression, where both eyes 2206 are deformed to a certain degree and open less than the "OPEN" expression. As the motor 2314 continues to rotate clockwise, the expressions that the example plush toy 2000 may manifest are "WINK," "ANGRY," "SAD," "BLINK," and then returning back to "OPEN."

In some embodiments, when the motor 2314 is programmed to rotate counter clockwise, the next expression from the default "OPEN" expression is the "BLINK" expression, where both eye 2206 are deformed and open less than the "OPEN" and the "HAPPY" expression. As the motor 2314 continues to rotate clockwise, the expressions that the example plush toy 2000 may manifest are "SAD," "ANGRY," "WINK," "HAPPY," and then returning back to "OPEN", for example.

In some embodiments, when a user touches a first sensor (e.g., a capacitive sensor on a portion of the head or other location of the example plush toy 2000) of the example plush toy 2000 once, the eyes 2206 may deform from "OPEN" to "HAPPY." When the user touches the first sensor once again (e.g., touch for the second time), the eyes 2206 may deform from "HAPPY" to "WINK". When the user touches the first sensor once again (e.g., touch for the third time), the eyes 2206 may deform from "WINK" directly to "ANGRY." When the user touches the first sensor once again (e.g., touch for the fourth time), the eyes 2206 may deform from "ANGRY" to "SAD." When the user touches the first sensor once again (e.g., touch for the fifth time), the eyes 2206 may deform from "SAD" to "BLINK." When the user touches the first sensor once again (e.g., touch for the sixth time), the eyes 2206 may deform from "BLINK" to "OPEN."

In some embodiments, when a user touches a first sensor (e.g., a capacitive sensor on a portion of the head of the example plush toy 2000) of the example plush toy 2000 once, the eyes 2206 may deform from "OPEN" to "HAPPY." In other embodiments, when a user touches the first sensor once, the eyes 2206 may deform from "OPEN" to "WINK" directly (e.g., without staying at the "HAPPY" expression). In other embodiments, when a user touches the first sensor once, the eyes 2206 may deform from "OPEN" directly to "ANGRY." In still other embodiments, when a user touches the first sensor once, the eyes 2206 may deform from "OPEN" to "SAD" directly. In yet other embodiments, when a user touches the first sensor once, the eyes 2206 may deform from "OPEN" to "BLINK" directly.

In some embodiments, some or all movements of the eyes 2206 can be paired with certain movements of other body parts (e.g., head, ear, eyebrows, mouth, nose, or the like) of the example plush toy 2000. As illustrated in FIGS. 7, 8, and 29, in some embodiments, the "WINK" expression can be paired with a movement of the example plush toy 2000. More specifically, when the example plush toy 2000 manifests the "WINK" expression, the example plush toy 2000 may also tilt or rotate its head in one direction.

Figure 30:
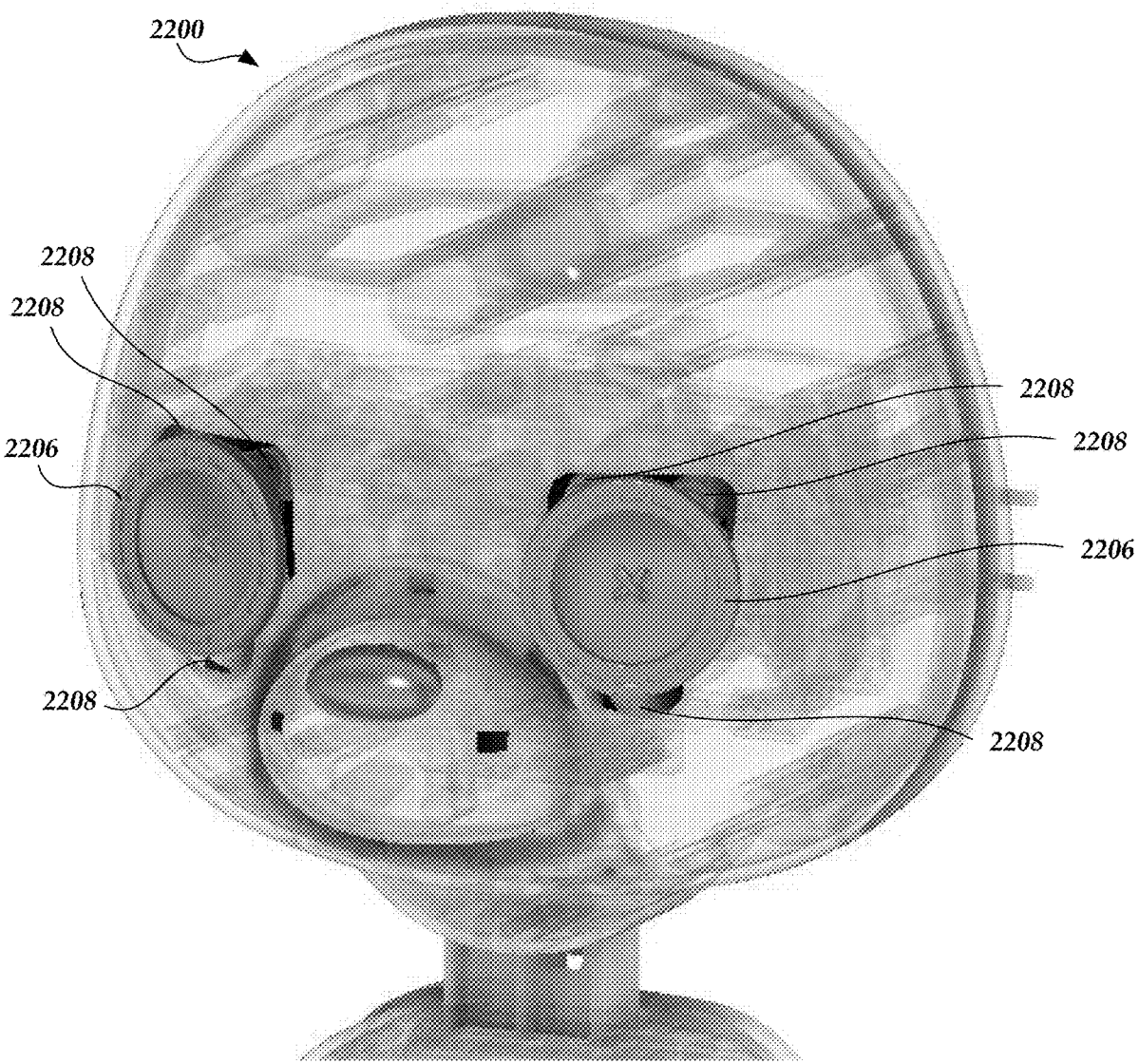
FIG. 30 is another front perspective view of an internal structure of the example plush toy illustrated in FIGS. 22A-22C.
Figure 31:
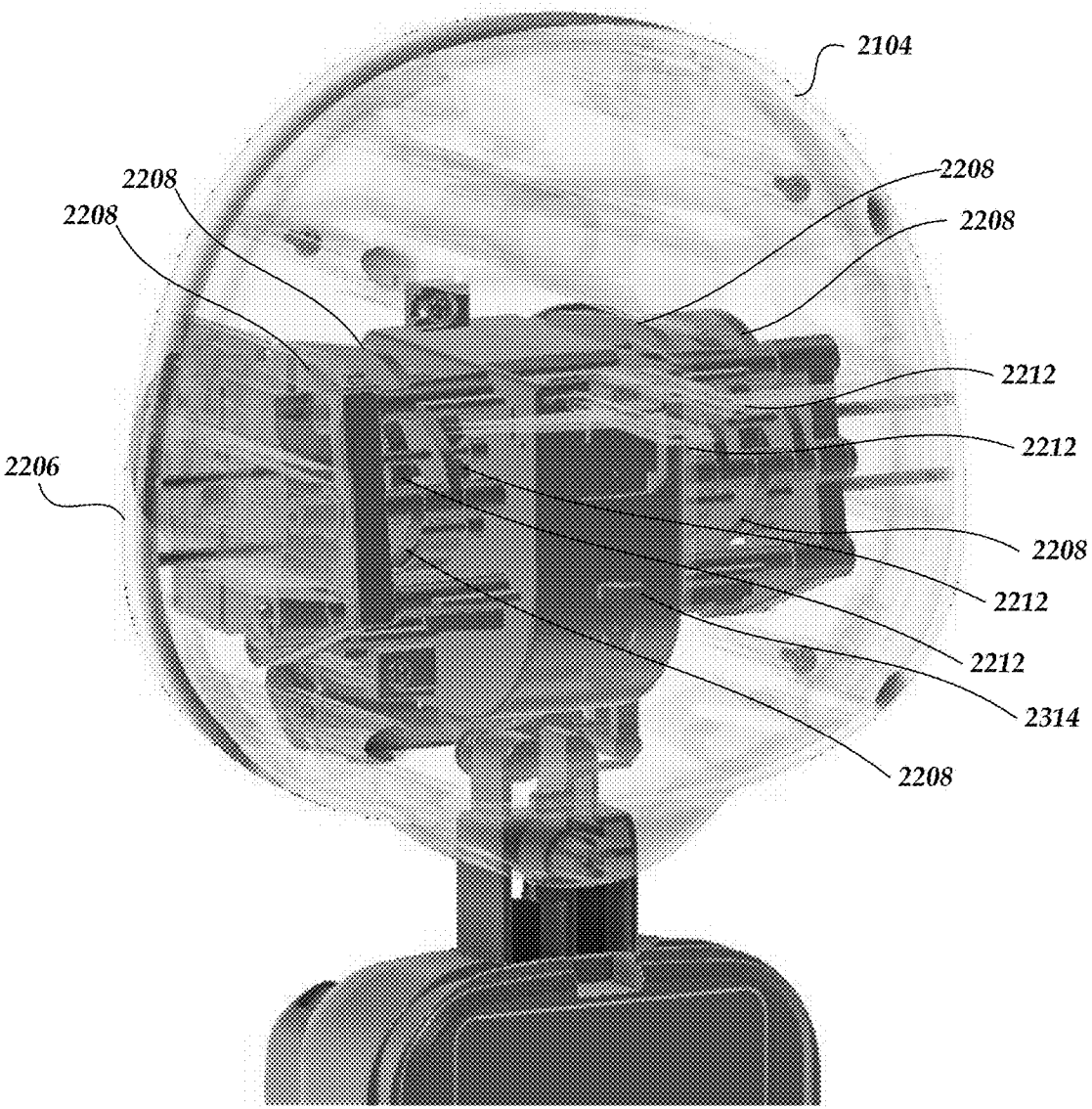
FIG. 31 is another back perspective view of the internal structure of FIG. 30.

FIG. 30 is another front perspective view of the internal structure 2200. FIG. 31 is a back perspective view of the internal structure 2200 of FIG. 30. As illustrated in FIG. 31, the motor 2314 is housed within the housing 2104. In operation, the motor 2314 may drive movements of the eyes 2206 of the plush toy 2000 to switch between different facial expressions. Specifically, the motor 2314 may power rotational movements (e.g., rotating forward or backward) of the rotating discs 2212, which in turn will cause the movement arms 2208 to move up or move down, thereby deforming the eyes 2206 into different shapes to accomplish different facial expressions through eye movements.

Figure 32:
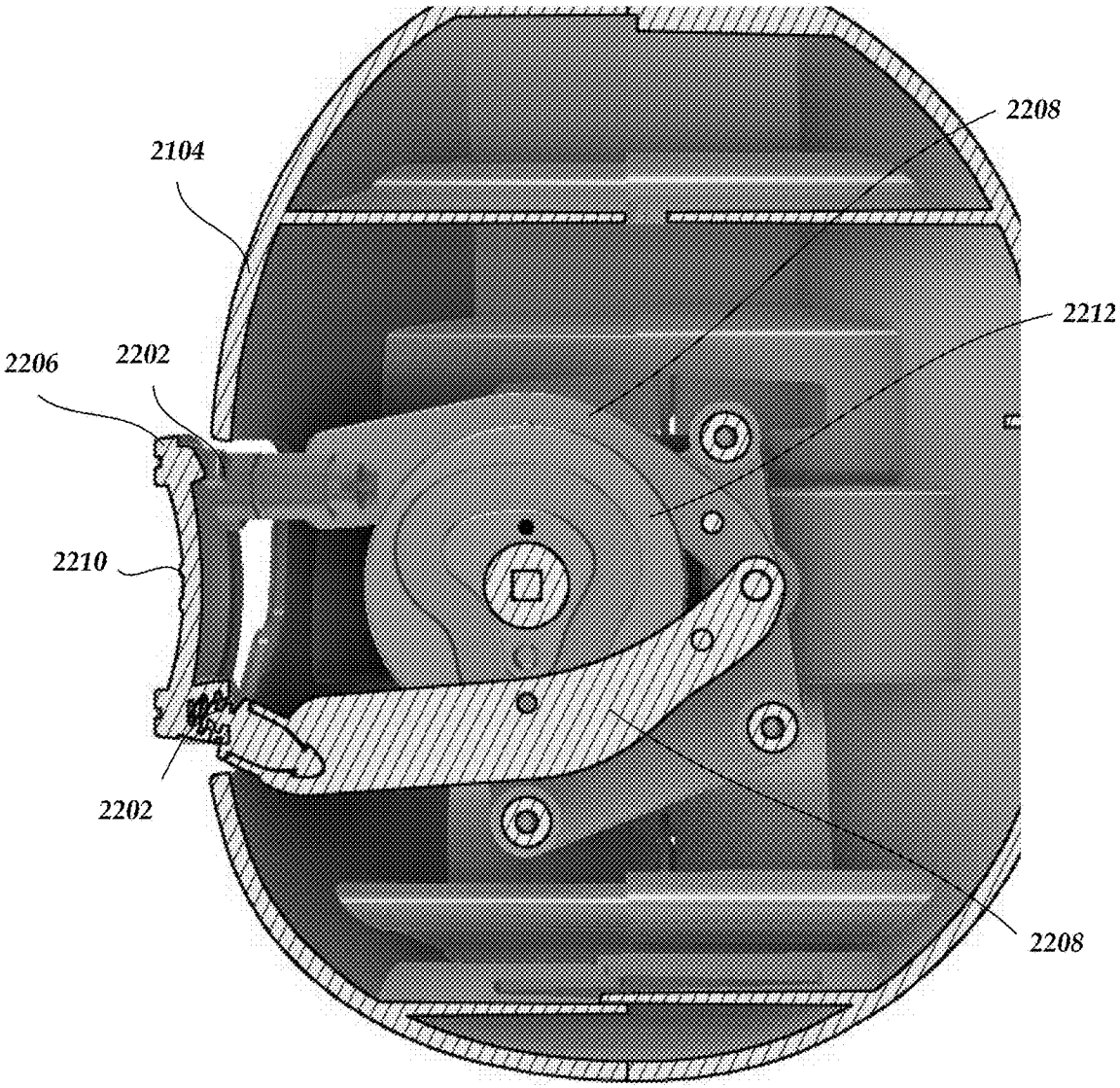
FIG. 32 is a cross-section view through the middle movement arm of the left eye of the example plush toy illustrated in FIGS. 22A-22C.
Figure 33:
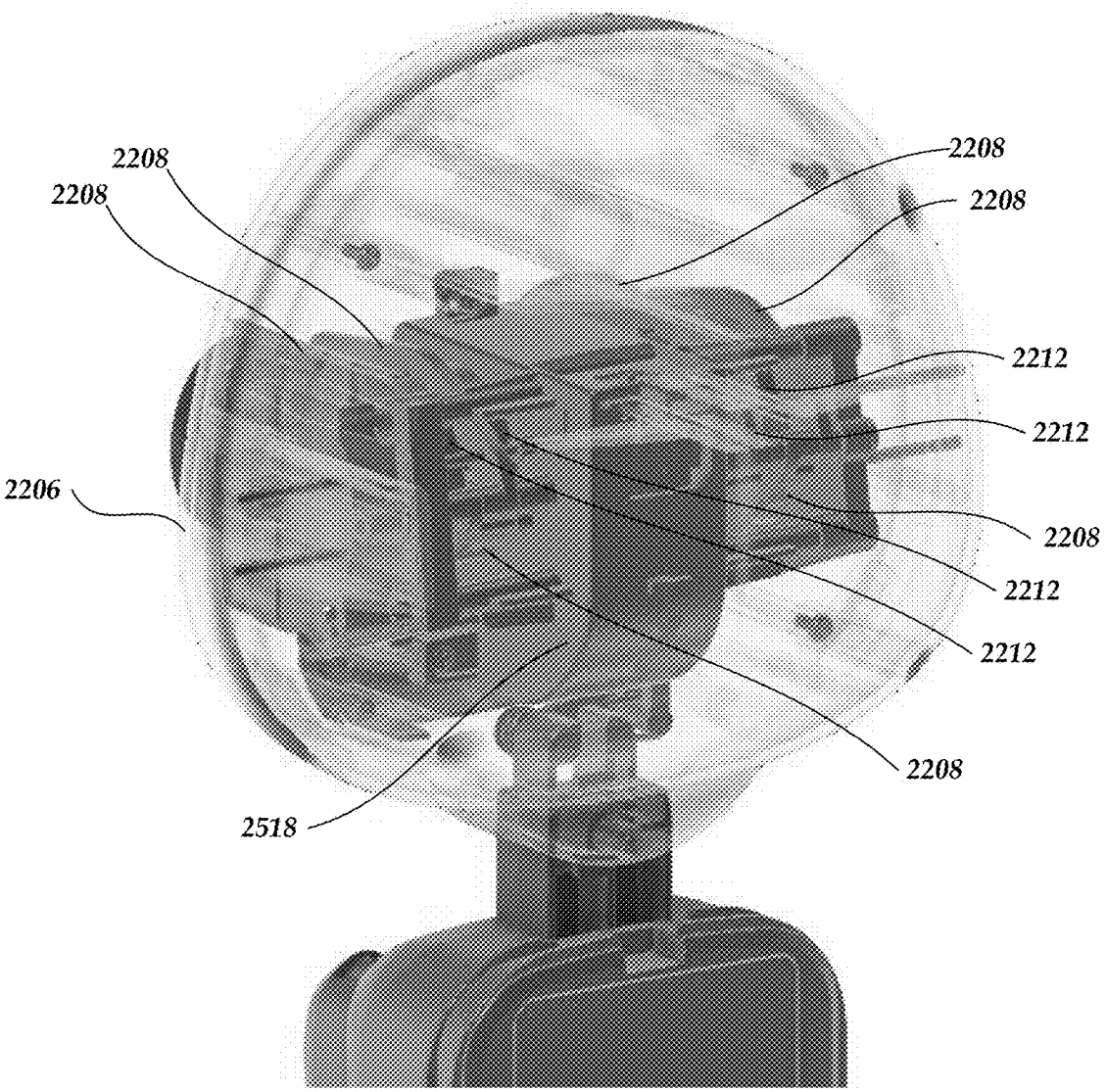
FIG. 33 is another back perspective view of the internal structure of FIG. 30 showing the gearbox.

FIG. 32 is a cross-section view through the middle movement arm 2208 of the left eye 2206. FIG. 33 is another back perspective view of the internal structure of FIG. 30. As shown most clearly in FIG. 32, for each of the eyes 2206, there are three attachment points 2202 associated with the movement arms 2208. As the movement arms 2208 move up or down, the eyes 2206 may be deformed (because of the moving up or down of the three attachment points 2202) into different shapes to provide different facial expressions of the plush toy 2000 through eye movements or varying eye shapes. Although three attachment points 2202 are associated with each of the eyes 2206, it should be noted that other number of attachment points 2202 may be associated with each of the eyes 2206.

Figure 34:
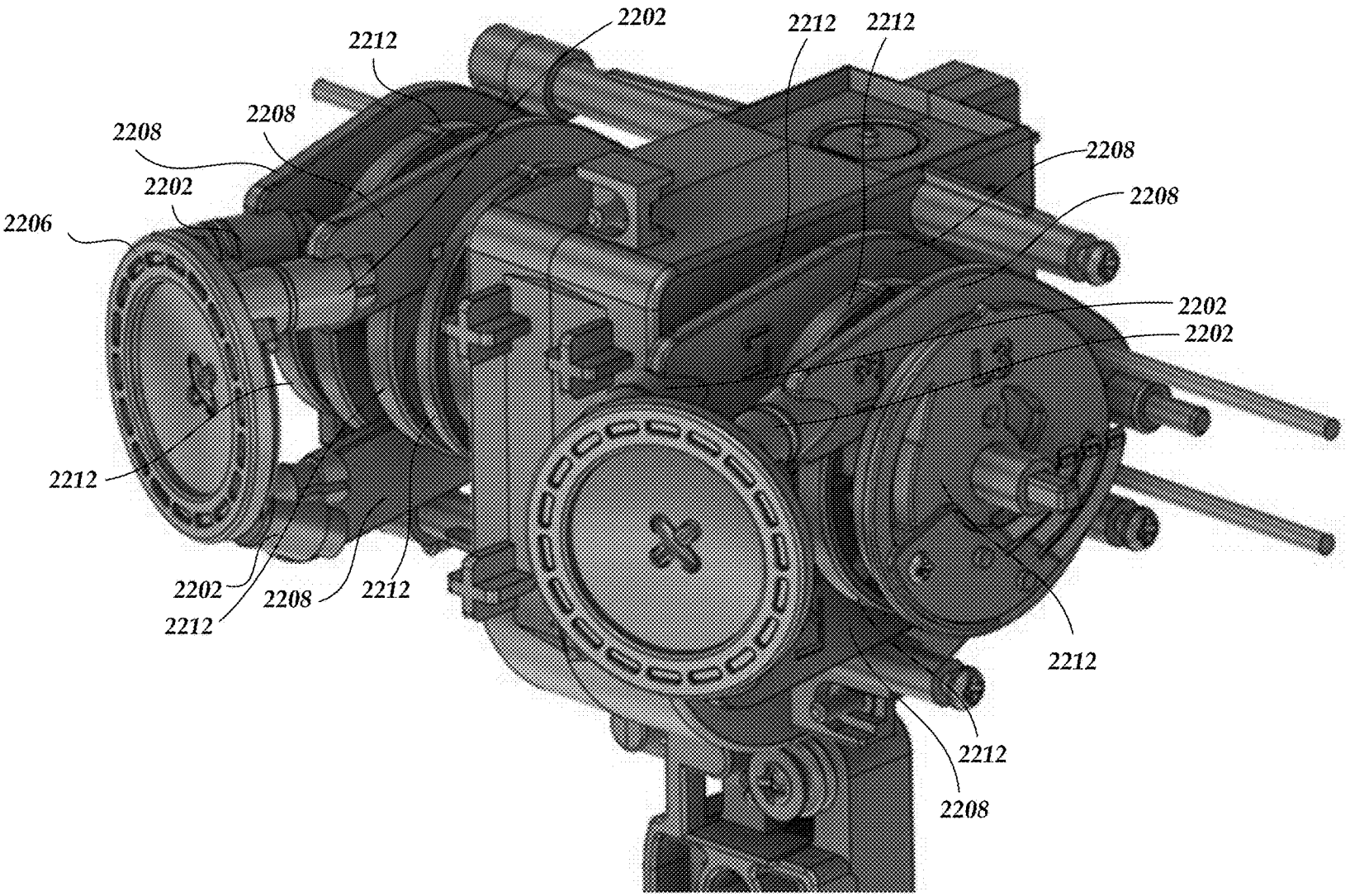
FIG. 34 is a partially exploded view with a left disk bracket removed to show one or more rotating discs and one or more movement arms of the example plush toy illustrated in FIGS. 22A-22C.
Figure 35:
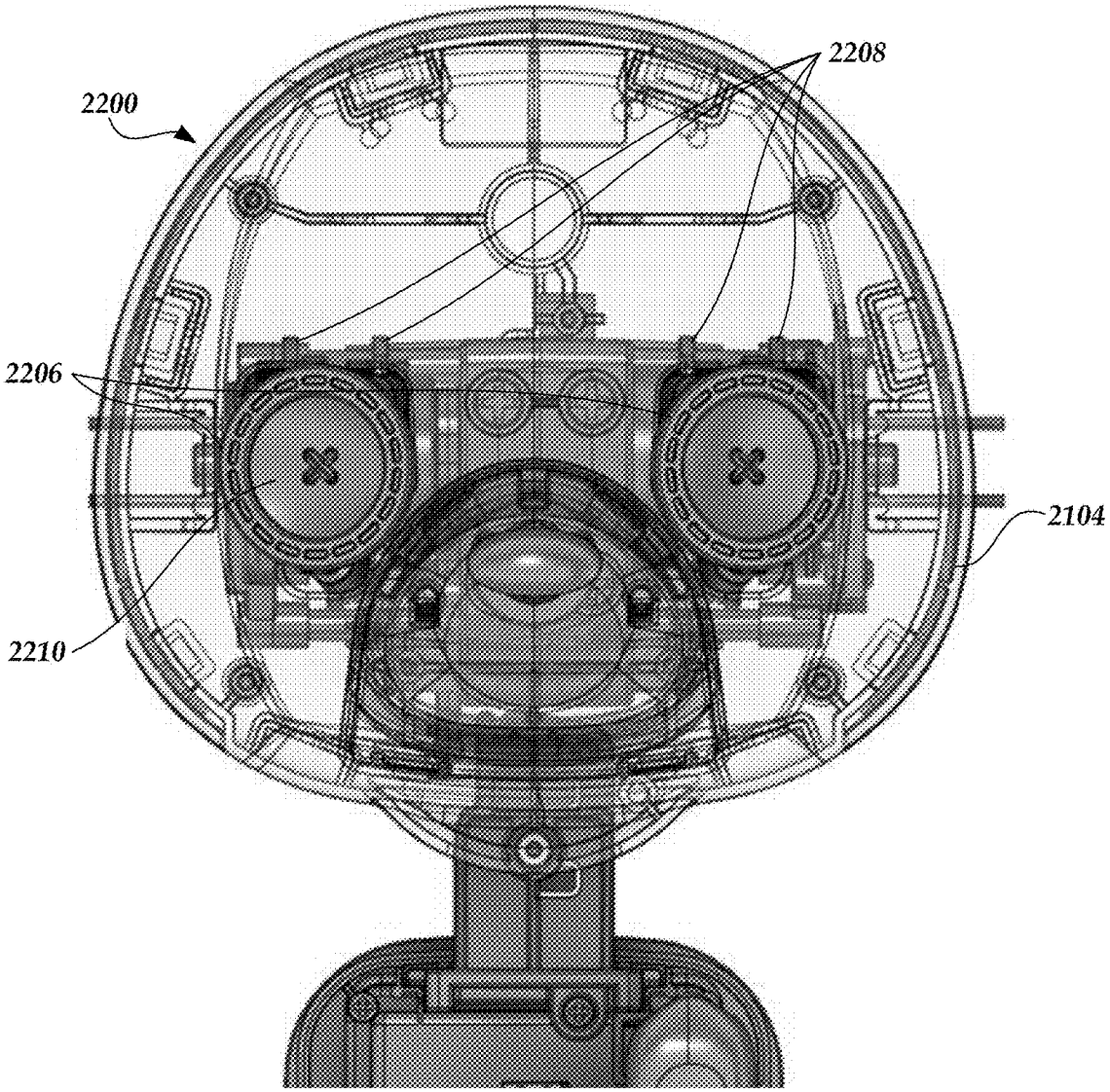
FIG. 35 is a front view of the internal structure of FIG. 30.

FIG. 34 is a partially exploded view with a left disk bracket removed to show one or more rotating discs 2212 and one or more movement arms 2208. FIG. 35 is a front view of the internal structure 2200. The movement of the rotating discs 2212 can be caused by the operation of the motor 2314 and the gearbox 2518. In some examples, the motor 2314 may be programmed to run specified turns so as to create different combinations of positions for the rotating discs 2212 and the movement arms 2208, thereby causing different facial expressions due to different eye movements.

Figure 36:
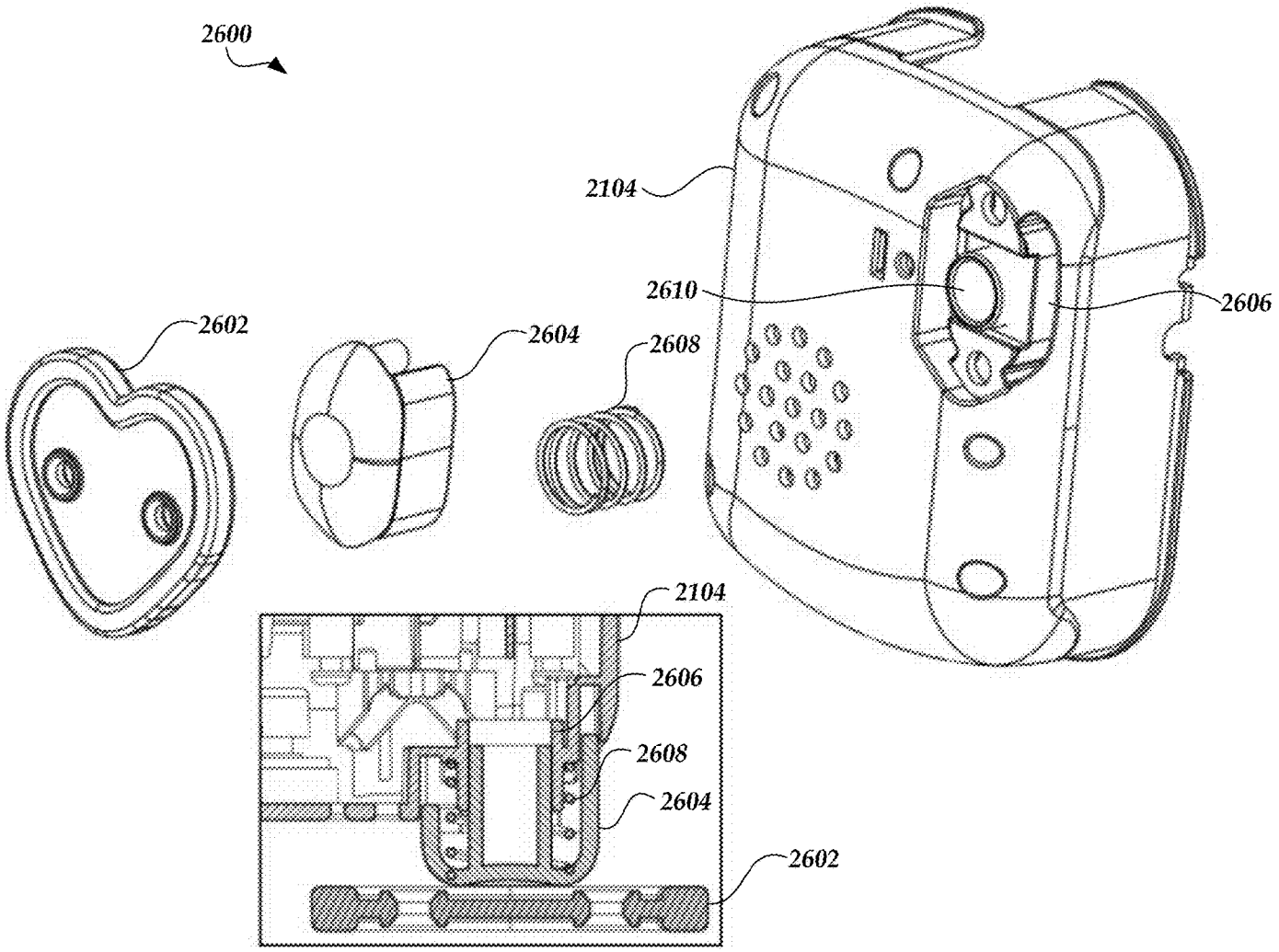
FIG. 36 is an exploded view of a heart system of the example plush toy of FIGS. 22A-22C.

FIG. 36 illustrates an exploded view of a heart system 2600 along with components (e.g., a heart shape 2602, a frame 2604, a heart micro switch 2606, a spring 2608, and/or a light 2610) of the heart system 2600 of a plush toy, such as the plush toy 2000 of FIGS. 22A-22C. In some embodiments, interactive operations can be activated by a user by turning on the heart micro switch 2606. In some embodiments, the light 2610 (e.g., LED) is mounted behind the fabric substrate 2416. In certain embodiments, activation of the heart micro switch 2606 causes the light 2610 (e.g., LED) to shine through and or illuminate the fabric substrate 2416 when on. In some embodiments, a user may tie or untie the pair of threads 2002.

Figure 37:
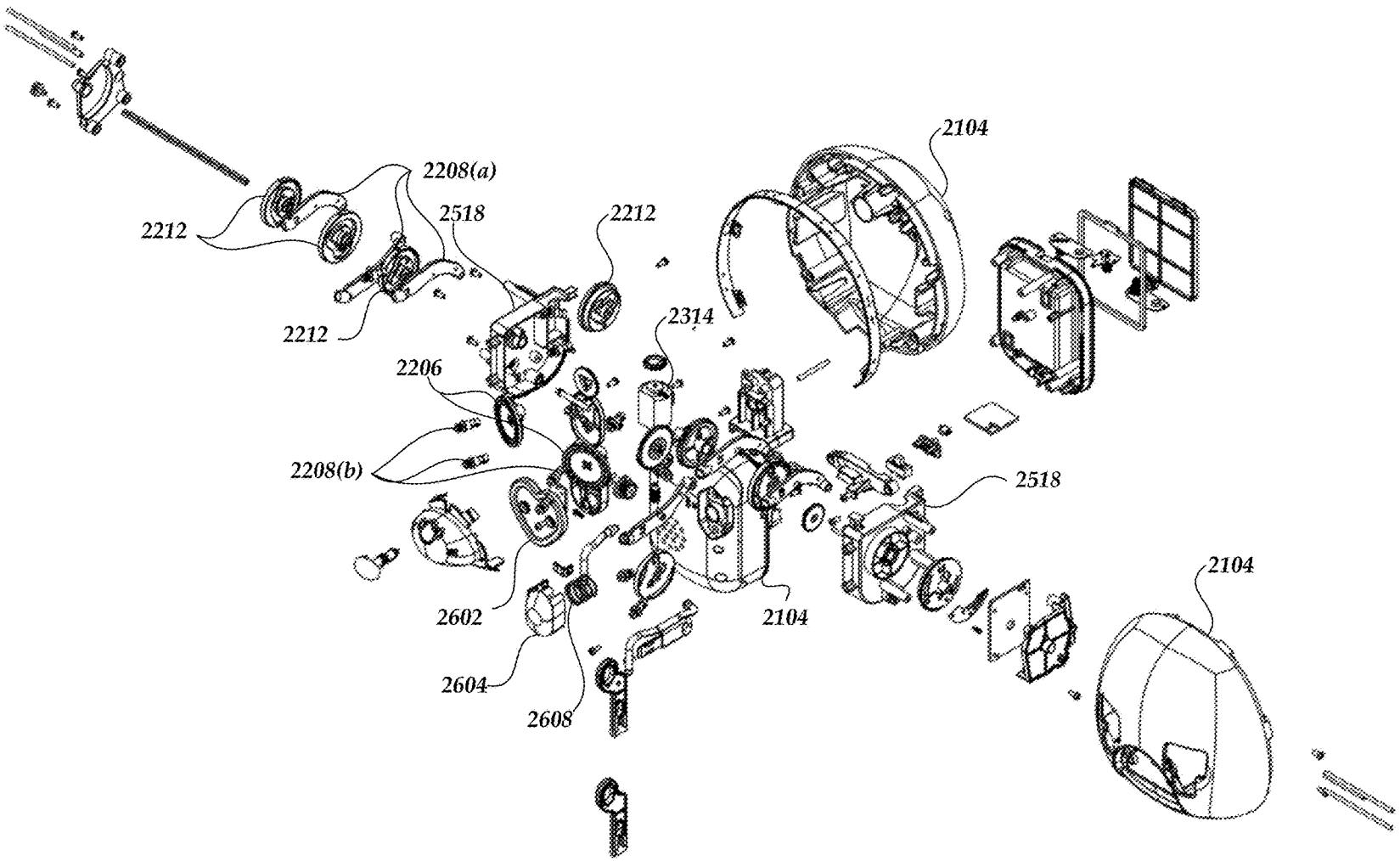
FIG. 37 illustrates an exploded view of some internal components of the example plush toy of FIGS. 22A-22C.

FIG. 37 illustrates an exploded view of some internal components of the plush toy 2000 of FIGS. 22A-22C. For example, FIG. 37 shows exploded views of parts of the housing 2104 of the plush toy 2000. Additionally, FIG. 37 shows an illustration of the rotating discs 2212 along with the movement arms 2208, where the rotating discs 2212 and movement arms 2208 can facilitate the movements of the eyes 2206. Further, FIG. 37 shows the motors 2314 and the exploded views of the gearbox 2518 along with gears inside the gearbox 2518. As discussed above, in some embodiments, the motion of the motor 2314 may turn the one or more gears inside the gearbox 2518, which in turn may cause the rotating discs 2212 to rotate. The rotation of the rotating discs 2212 may cause the movement arms 2208 to change positions, thereby producing different movements of the eyes 2206. In some examples, the movements of the eyes 2206 may be paired with the movements of other body parts (e.g., head tilting) of the plush toy 2000.

Terminology

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

For expository purposes, the term "horizontal" as used herein is defined as a plane parallel to the plane or surface of the floor or ground of the area in which the device being described is used or the method being described is performed, regardless of its orientation. The term "floor" can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. In addition, certain blocks may be omitted in some implementations. The methods and processes described herein are also not limited to any particular sequence, and the blocks or states relating thereto can be performed in other sequences that are appropriate.

Many variations and modifications may be made to the above-described embodiments, the elements of which are to be understood as being among other acceptable examples. All such modifications and variations are intended to be included herein within the scope of this disclosure. The foregoing description details certain embodiments. It will be appreciated, however, that no matter how detailed the foregoing appears in text, the systems and methods can be practiced in many ways. As is also stated above, it should be noted that the use of particular terminology when describing certain features or aspects of the systems and methods should not be taken to imply that the terminology is being re-defined herein to be restricted to including any specific characteristics of the features or aspects of the systems and methods with which that terminology is associated.

While the above detailed description has shown, described, and pointed out novel features as applied to various embodiments, it may be understood that various omissions, substitutions, and changes in the form and details of the devices or processes illustrated may be made without departing from the spirit of the disclosure. As may be recognized, certain embodiments of the inventions described herein may be embodied within a form that does not provide all of the features and benefits set forth herein, as some features may be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. An interactive toy comprising:

an eye;

a first sensor configured to generate a first electrical signal in response to a first contact applied on the first sensor by a user; and a controller, wherein in response to receiving the first electrical signal, the controller deforms the eye under load to open to a first degree.

2. The interactive toy of claim 1, wherein the first sensor is a capacitive sensor.

3. The interactive toy of claim 1, further comprising a second sensor configured to generate a second electrical signal in response to a second contact applied on the second sensor by the user, wherein in response to receiving the second electrical signal, the controller causes the eye to open to a second degree, the second degree being different than the first degree.

4. The interactive toy of claim 3, further comprising a motor, wherein in response to receiving the first electrical signal, the controller triggers the motor to rotate a first number of turns to cause the eye to open to the first degree, and wherein in response to receiving the second electrical signal, the controller triggers the motor to rotate a second number of turns to cause the eye to open to the second degree.

5. The interactive toy of claim 1, further comprising a body part, wherein the body part is a head or an ear of the interactive toy, and wherein in response to receiving the first electrical signal, the controller further causes the body part to move in a first direction.

6. An interactive toy comprising:

an eye configured to change from a first shape to a second shape;

a sensor configured to generate an electrical signal in response to a user interaction;

one or more rotating discs; and a controller, wherein in response to receiving the electrical signal, the controller causes the one or more rotating discs to deform a shape of the eye under load from the first shape to the second shape.

7. The interactive toy of claim 6, wherein one of the first shape or the second shape is OPEN.

8. The interactive toy of claim 6, wherein one of the first shape or the second shape is HAPPY where at least a bottom of the eye is not fully open.

9. The interactive toy of claim 6, wherein one of the first shape or the second shape is WINK.

10. The interactive toy of claim 6, wherein one of the first shape or the second shape is ANGRY where at least a top of the eye is partially closed.

11. The interactive toy of claim 6, wherein one of the first shape or the second shape is SAD where at least a top of the eye is partially closed.

12. The interactive toy of claim 6, wherein one of the first shape or the second shape is BLINK.

13. The interactive toy of claim 6, further comprising a body part, wherein the controller is further configured to cause the body part to move in a first direction.

14. The interactive toy of claim 13, wherein the body part is a head.

15. An interactive toy comprising:

an eye configured to deform from a first shape to a second shape;

a sensor configured to generate an electrical signal in response to a user interaction;

a plurality of movement arms; and a controller, wherein in response to receiving the electrical signal, the controller causes the plurality of movement arms to deform a shape of the eye under load from the first shape to the second shape.

16. The interactive toy of claim 15, wherein the plurality of movement arms comprises at least three movement arms, and wherein each of the at least three movement arms couples to the eye at a different connection point.

17. The interactive toy of claim 16, wherein two of the at least three movement arms connect to the eye on an upper side of the eye, and wherein one of the at least three movement arms connects to the eye on a lower side of the eye.

18. The interactive toy of claim 15, further comprising a fabric substrate covering the interactive toy, and wherein the eye is molded on the fabric substrate.

19. An interactive toy comprising:

an eye configured to change from a first shape to a second shape;

a sensor configured to generate an electrical signal in response to a user interaction;

a plurality of movement arms; and a controller, wherein in response to receiving the electrical signal, the controller causes the plurality of movement arms to change a shape of the eye from the first shape to the second shape, wherein the plurality of movement arms comprises at least three movement arms, and wherein each of the at least three movement arms couples to the eye at a different connection point, and wherein two of the at least three movement arms connect to the eye on an upper side of the eye, and wherein one of the at least three movement arms connects to the eye on a lower side of the eye.

* * * * *